US007690162B2

(12) United States Patent
Chambers

(10) Patent No.: US 7,690,162 B2
(45) Date of Patent: Apr. 6, 2010

(54) METHODS, APPARATUSES, AND ASSEMBLIES FOR LOG BUILDING

(75) Inventor: Robert W. Chambers, River Falls, WI (US)

(73) Assignee: Accelerated Log Building, Inc., River Falls, WI (US)

( * ) Notice: Subject to any disclaimer, the term of this patent is extended or adjusted under 35 U.S.C. 154(b) by 841 days.

(21) Appl. No.: 11/389,721

(22) Filed: Mar. 27, 2006

(65) Prior Publication Data

US 2007/0220820 A1 Sep. 27, 2007

(51) Int. Cl.
*E04B 1/10* (2006.01)

(52) U.S. Cl. ..... 52/233; 52/592.5; 52/747.1

(58) Field of Classification Search ..... 52/741.1, 52/745.5, 745.09, 745.2, 745.19, 233, 592.5, 52/747.1, 745.01
See application file for complete search history.

(56) References Cited

U.S. PATENT DOCUMENTS

| | | | | | |
|---|---|---|---|---|---|
| 2,040,110 | A | | 5/1936 | Tahvonen | 52/220 |
| 2,130,231 | A | | 9/1938 | Forciea | 52/233 |
| 2,525,659 | A | | 10/1950 | Edson et al. | 52/233 |
| 3,381,428 | A | | 5/1968 | Sillman | 52/233 |
| 3,685,129 | A | | 8/1972 | Jureit | 29/407 |
| 3,863,409 | A | | 2/1975 | Fell | 446/106 |
| 3,908,322 | A | | 9/1975 | Shoaf | 52/92.1 |
| 4,047,350 | A | | 9/1977 | Chisum | 52/593 |
| RE29,805 | E | * | 10/1978 | Koehnen | 414/734 |
| 4,230,163 | A | | 10/1980 | Barton | 144/341 |
| 4,336,439 | A | | 6/1982 | Sasnett | 219/121 |
| 4,412,297 | A | * | 10/1983 | Halgrimson et al. | 700/302 |
| 4,510,724 | A | | 4/1985 | Magnuson | 52/233 |
| 4,527,981 | A | | 7/1985 | Chisum | 434/72 |
| 4,901,489 | A | | 2/1990 | Garber | 52/233 |
| 4,951,435 | A | | 8/1990 | Beckedorf | 52/233 |
| 4,984,961 | A | | 1/1991 | Herolf | 414/786 |
| 5,058,343 | A | | 10/1991 | Nipko | 52/233 |
| 5,103,610 | A | | 4/1992 | Walters | 52/233 |
| 5,505,028 | A | | 4/1996 | Giles | 52/233 |
| 5,577,356 | A | | 11/1996 | Hubbard | 52/233 |
| 5,608,997 | A | | 3/1997 | Mahowich | 52/233 |
| 5,718,091 | A | | 2/1998 | Sellers et al. | 52/233 |
| 6,023,895 | A | * | 2/2000 | Anderson | 52/233 |
| 6,412,241 | B1 | * | 7/2002 | Chambers | 52/233 |
| 6,564,526 | B2 | * | 5/2003 | Chambers | 52/747.1 |
| 2002/0088200 | A1 | * | 7/2002 | Chambers | 52/747.1 |
| 2004/0099706 | A1 | * | 5/2004 | Krautkramer et al. | 226/1 |
| 2004/0182023 | A1 | * | 9/2004 | Chambers | 52/233 |
| 2006/0115355 | A1 | * | 6/2006 | Hall | 414/687 |

OTHER PUBLICATIONS

Robert W. Chambers, "Log Building Construction Manual", 1999.
Robert W. Chambers, "Accelerated Log Building", Jul. 2000.

(Continued)

*Primary Examiner*—Basil Katcheves
*Assistant Examiner*—Joshua Ihezie
(74) *Attorney, Agent, or Firm*—Fredrikson & Byron, PA

(57) ABSTRACT

The invention provides technology for building houses and many other structures using logs. Log-positioning apparatuses are provided. Also provided are assemblies that include a plurality of logs and a plurality of log-positioning apparatuses. Finally, various log building methods are provided.

30 Claims, 12 Drawing Sheets

OTHER PUBLICATIONS

Robert W. Chambers, "Accelerated Log Building", 2000.
Robert W. Chambers, "Log Construction Manual the Ultimate Guide to Building Handcrafted Homes", 2002.
"Log Cabins", American Builder, Feb. 1933, p. 33 and 58.
Mitchell, James, The Craft of Modular Post & Beam, 1984,1997, pp. 1-368; Hartley & Marks Publishers, Inc., Point Roberts, WA, 98281, USA.

* cited by examiner

METHODS, APPARATUSES, AND ASSEMBLIES FOR LOG BUILDING

FIELD OF THE INVENTION

The present invention relates to constructing log structures. More particularly, this invention relates to methods for constructing log structures and apparatuses for constructing log structures.

BACKGROUND OF THE INVENTION

Log structures have been built for centuries. Historically, log structures were handcrafted using logs in their natural shape. That is, using logs that retain the unique, natural shapes of the trees from which they came. More recently, log buildings have been constructed using prefabricated logs. For example, such logs are commonly manufactured to have a common shape, whereby they can be used interchangeably. While prefabricated log structures can be built more quickly and affordably than those built by hand, many people prefer the aesthetics of a handcrafted log home. Accordingly, handcrafted homes remain popular even though their construction commonly involves significant time and expense.

The general procedure used in log construction developed long before the advent of cranes and other mechanized lifting equipment. Because logs are heavy, awkward, and dangerous to lift, early log builders did not want to lift logs onto a wall more than once. Thus, once each log was positioned upon a wall, it was processed completely until it fit in its permanent position on the wall. Only then would the next log be processed. Thus, at any given time, only the logs that were on the exposed top layer would be processed. Even though this general procedure was invented for log construction without modern lifting equipment, this procedure is used even today by those who build handcrafted log homes. This traditional procedure will now be described as it would typically be applied in building a simple four-walled structure.

Each log is processed one-at-a-time through a series of steps to produce a handcrafted log structure. First, a set of logs are selected and the bark is removed from each log. The first-layer logs are then selected and positioned. Traditionally, each of the first-layer and second-layer logs (or "sill logs") is cut to have a planar bottom surface that will rest on the floor deck to provide the structure with a solid foundation. Two first-layer logs are positioned in a parallel, spaced-apart configuration.

(In the present background section, terms like "first-layer" and "second-layer" logs are used to refer to the two layers of logs that are closest to the ground. Throughout the rest of this disclosure. for example, and unless otherwise specified, in the assemblies and methods described in the detailed description section, terms like "first-layer logs" and "second-layer logs" are used simply to refer to logs of any two adjacent layers, even though those logs need not ultimately be the two layers that are closest to the ground in the resulting shell.)

Each additional layer comprises two logs that are stacked crosswise over the logs of the layer below. For example, the second-layer in such a structure comprises two logs positioned in a crosswise stack on top of the first-layer logs. A notch is marked near both ends of each second-layer log, then the notches are cut, whereafter the second-layer logs are re-stacked over the first-layer logs with each notch fitted over the end of a first-layer log. The notches in the second-layer logs are commonly dimensioned such that the planar bottom surfaces of the second-layer logs will be flush with the planar bottom surfaces of the first-layer logs when these notches are fitted over the first-layer logs.

Once the first-layer and second-layer logs are in place and fitted, the third-layer logs are selected and lifted into place. Each third-layer log is positioned in a crosswise stack atop the second-layer of logs such that each third-layer log lies directly above a first-layer log. At this stage, there is a gap between each pair of adjacent first-layer and third-layer logs. This gap will often be wider at one end than at the other. Both ends of this gap are measured to determine how the adjacent third-layer log can be lowered to make the gaps more uniform from end to end. A rough notch is then cut into the end of the third-layer log that is adjacent the wide end of the gap. The depth of this rough notch is such that when it is fitted over the second-layer log below, the third-layer log is lowered to a position where the vertical height of the gap is about the same at both ends. Commonly, a rough notch is cut into both ends of each third-layer log so each gap is made to be both less tall and more uniform. But it is not uncommon for no rough notches to be cut at all, or for rough notches to be cut in only one end of a log, instead of both ends, of a given log.

Even after rough notching, there will commonly be one area where the gap between each pair of adjacent first-layer and third-layer logs is greatest. This is because each log has a unique and irregular shape that corresponds to the natural shape of the tree from which it came. The maximum height of this gap is measured for each pair of adjacent first-layer and third-layer logs.

A marking instrument similar to an inside caliper is then used to mark (or "scribe") a long groove that will be cut in the bottom surface of each third-layer log. The marking points of the caliper (or "scriber") are set to a distance (the "scribe setting") that is slightly greater than the maximum gap height that was found for that particular pair of adjacent first-layer and third-layer logs. Because the maximum gap between each pair of adjacent first-layer and third-layer logs will commonly be different, the scribe setting for each such pair of logs will likewise be different.

The scriber is used to mark a final notch cut on both ends of each third-layer log. The scriber is used to mark a final notch cut that will lower each end of each third-layer log by the same distance that was used to mark the long groove cut for that pair of logs.

The long groove and the final notches are then cut for each third-layer log. This is commonly done by rolling each third-layer log upside down and cutting the long groove and the final notches that have been scribed. Alternatively, each third-layer log may be removed from the wall and placed near the ground for cutting. Each third-layer log is then put in its finally fitted position. Only after the third-layer logs have been completely processed and fitted into their final position, does the builder begin working on the fourth-layer logs. The same steps are performed for each fourth-layer log until each log in the fourth-layer is fitted into its final position. This process is repeated for each of the remaining logs in the walls of the structure. Thus, each log on the exposed upper layer is fully processed and placed into its final, permanent position before any work is done on logs of higher layers.

As can be seen, the traditional method of fully processing each log one log at a time is inefficient and slow. For example, a four-walled building with nine logs in each wall will comprise 36 logs. However, using the traditional method, only two out of 36 logs are processed at one time. Thus, even a small, simple log structure takes a long time to build with the traditional method. Clients can be frustrated by the slow pace at which handcrafted structures are built. Accordingly, the development of the log building industry has been affected by the high costs and lengthy wait-times that are characteristic of the traditional log-by-log building method.

In short, traditional methods are adequately suited to building on the final foundation and without a crane. However, they are poorly suited to building off-site and with a crane. Traditional methods were adequate in the year 1620, but they are now poor business choices.

Modern mass-production methods typically benefit from using work forces comprised of specialized laborers rather than small work crews of highly-skilled craftsmen. It is difficult to use a large number of workers in traditional log building methodology. Since only a few logs are processed at one time, there is only enough work for a few workers to do. Thus, log building companies typically keep each work crew small. Furthermore, when crews are small, it is useful if each worker is skilled at performing many log construction tasks. This makes specialization of labor difficult. It is also time-consuming and costly to hire and keep workers who are proficient at the full spectrum of tasks. Likewise, it is expensive to adequately train workers in all of the numerous skills required in log building. Furthermore, those workers who become skilled at all aspects of log construction are sometimes tempted to leave employment to start their own log construction business. In summary, log building companies can find employment, training, and maintenance of skilled workers and crews to be a continuing expense.

The traditional method of log building can also be unsafe. It can be difficult and expensive to erect scaffolding around a log structure during construction. Thus, where long grooves are cut into logs that are resting atop walls, workers may be required to walk backwards on top of the log walls while operating a chainsaw. For example, this may be the case where double-cut long grooves are used. This type of groove is disclosed in U.S. Pat. No. 4,951,435, which is issued to Beckedorf (the entire teachings of which are incorporated herein by reference).

It is common to assemble each log shell twice using traditional log building methods. Commonly, the shell is built once at the construction yard and again at its final location. Since each log is fully processed one at a time with the traditional method, this adds significantly to the construction time. This also means that each log is handled many times. Inevitably, there are costs and risks each time that heavy, awkward logs are handled at a construction site. There is a risk of accident each time a log is moved or lifted. Furthermore, the peeled, natural surface of each log can be scratched and dented by lifting tongs. Such damage is undesirable since the peeled surface of the log commonly serves as the finished surface of the walls.

Surprisingly, log home builders today use the same basic procedures that builders were using hundreds of years ago. It would be desirable to provide more efficient methods for building handcrafted structures with naturally-shaped logs. It would also be desirable to provide log-positioning apparatuses that can be used to facilitate efficient log building methods.

SUMMARY OF THE INVENTION

In certain embodiments, the invention provides an apparatus for building log structures. In the present embodiments, the apparatus comprises an adjustment shaft and a support arm, and the support arm is adapted to supportably receive a bottom side region of a log. Preferably, the adjustment shaft has an axis and is operably coupled to the support arm such that the support arm can be moved vertically in response to rotation of the adjustment shaft about its axis and/or in response to linear movement of the adjustment shaft along its axis. In the present embodiments, the support arm can optionally be provided with a wedge system that includes two converging surfaces defining a valley such that the bottom side region of the log can be disposed in the valley and thereby cradled by the two converging surfaces. In such cases, preferably, at least part of the wedge system can be moved along a length of the support arm such that the valley can be centered at different points along the length of the support arm. When provided, the two converging surfaces can optionally be defined by a pair of wedge bodies, and the wedge system can optionally include a lateral-adjustment rod which when rotated causes both wedge bodies of the pair to move along the support arm. When provided, the wedge system can preferably be adjusted so as to move the two converging surfaces selectively closer together or further apart, such that when the bottom side region of the log is cradled by the two converging surfaces the log can be moved to a higher elevation by moving the two converging surfaces closer together, and such that when the bottom side region of the log is cradled by the two converging surfaces the log can be moved to a lower elevation by moving the two converging surfaces further apart. When provided, the two converging surfaces preferably are defined by a pair of wedge bodies, the wedge system optionally includes a height-adjustment rod that can be rotated in first and second directions such that rotation of the height-adjustment rod in the first direction results in the two wedge bodies moving closer together and rotation of the height-adjustment rod in the second direction results in the two wedge bodies moving further apart. When provided, the wedge system can optionally include a rotatable member that facilitates moving the log in a lengthwise manner while the log is cradled by the two converging surfaces. When provided, the wedge system can optionally include a rotatable member that facilitates rotating the log about its long axis while the log is cradled by the two converging surfaces. Preferably, the wedge system, when provided, includes a plurality of multi-directional rotatable members, wherein the multi-directional rotatable members directly contact the log when the log is cradled by the two converging surfaces, wherein the multi-directional rotatable members are each adapted to rotate about two axes separated by about 90 degrees, such that when the log is cradled by the two converging surfaces a position of the log can be adjusted by rolling the log on the multi-directional rotatable members so as to move the log along its long axis, and when the log is cradled by the two converging surfaces the position of the log can be adjusted by rolling the log on the multi-directional rotatable members so as to rotate the log about its long axis. In the present embodiments, the apparatus can optionally be configured such that, while the log is supportably received on the support arm, a position of the log can be adjusted by moving the log in a lengthwise manner, a lateral manner, a vertical manner, or a rotational manner. For example, in some cases, the position of the log can be adjusted in a vertical manner without moving the entire support arm to a higher or lower elevation. Preferably, the support arm is mounted removably to a frame of the apparatus. Optionally, the apparatus is configured such that the support arm, when unloaded, is adapted for being removed from the frame by a removal technique that comprises pivoting the support arm about a horizontal axis. In some cases, the support arm is mounted removably to the frame by an attachment mechanism comprising two bearing members engaging the frame at different elevations. Such two bearing members, for example, can respectively engage first and second sides of the frame, and these first and second sides can optionally be opposed. In some cases, at least one of the two bearing members is adapted to ride along a vertical track on the frame. Preferably, the bearing member with the lowest elevation engages a distal track and the bearing member with the highest elevation engages a proximal track, such that the engagement of the bearing members and the tracks restricts lateral motion of the support arm. Here, the term "distal track" and "proximal track" refer to their proximity to the adjustment shaft. Thus, the proximal track is closer to the adjustment shaft than the distal shaft. In some cases, the apparatus is configured such that the support arm, when unloaded, can be removed from the frame and decoupled from the adjustment shaft by a single-operator technique. Further, the apparatus can optionally be configured such that the support arm, after previously having been removed from the frame and decoupled from the adjustment shaft, can be mounted to the frame and operably coupled to the adjustment shaft by a single-operator technique. In some of the present embodiments, at least part of the adjustment shaft is exteriorly threaded, and the support arm is operably coupled to the adjustment shaft by an attachment mechanism comprising an interiorly threaded fastener that extends only a partial circumferential extent around the adjustment shaft. The interiorly threaded fastener, for example, can comprise at least one split nut member. In one group of the present embodiments, the adjustment shaft is operably coupled to a motor adapted for rotating the adjustment shaft about its axis and/or moving the adjustment shaft linearly along its axis. Preferably, the present apparatus is adapted to support a weight of at least about 60 pounds. The apparatus desirably has a stable base that can be positioned upon the ground or another flooring surface so as to provide a stable support for the apparatus when the bottom side region of the log is supportably received on the support arm. In some of the present embodiments, the axis of the adjustment shaft defines a vertical axis of the apparatus, and the support arm extends away from the adjustment shaft in a generally horizontal direction. In certain cases, the apparatus will include a plurality of support arms adapted to supportably receive bottom side regions of respective logs, and the adjustment shaft will be operably coupled to the support arms such that all the support arms simultaneously move vertically in response to rotation of the adjustment shaft about its axis and/or in response to linear movement of the adjustment shaft along its axis.

In certain embodiments, the invention provides an assembly comprising a plurality of logs and a plurality of (optionally at least eight) log-positioning apparatuses. Each log has a first end region and a second end region. In the present assembly embodiments, each log-positioning apparatus comprises a support arm that can be moved vertically so as to raise or lower at least a portion of one of the logs, and bottom side regions of the logs are supportably received on the support arms of respective ones of the log-positioning apparatuses. In the present assembly, the logs are maintained in a configuration (this configuration can also be referred to as a "stack assembly") comprising: (a) a first-layer log held above ground; (b) a second-layer log held in a position wherein at least one end region of the second-layer log is disposed above the first-layer log; and (c) a third-layer log held in a position wherein at least one end region of the third-layer log is disposed above the second-layer log. In some of the present assembly embodiments, the configuration has an uppermost layer of logs that is close enough to the ground to allow a builder to scribe final notch and long groove lines on logs of the uppermost layer while standing on the ground. In some of the present assembly embodiments, a bottom surface of the uppermost layer of logs is no more than about 70 inches above the ground. Preferably, the noted first-layer log, second-layer log, and third-layer log are identified for being assembled together with other logs to produce a predetermined shell, the predetermined shell has a desired total number of layers of logs, and the noted configuration (or "stack assembly") has at least one less layer of logs than the desired total number. For example, the noted configuration can optionally have logs from only three layers, and those logs can be identified for being assembled together with other logs to produce a predetermined shell having at least four layers. In some of the present embodiments, the third-layer log is not in direct contact with the second-layer log and/or the second-layer log is not in direct contact with the first-layer log. In the present embodiments, the support arms of the log-positioning apparatuses preferably are adapted for being simultaneously moved vertically by a common increment in response to operation of one or more motors. The assembly, for example, can comprise a plurality of motors, and each log-positioning apparatus can have a motor. Optionally, the assembly can include a controller adapted for actuating one or some of the motors, optionally for simultaneously actuating at least a subset (e.g., some, substantially all, or all) of the motors. Preferably, each log-positioning apparatus includes an adjustment shaft and a support arm operably coupled to the adjustment shaft, and the support arm is adapted to move vertically in response to rotation of the adjustment shaft and/or in response to linear movement of the adjustment shaft. The support arm, for example, can optionally be adapted to move vertically in response to rotation of the adjustment shaft, and the adjustment shaft can be operably coupled to a stepper motor adapted for rotating the adjustment shaft. In the present assembly, the noted third-layer log will in many cases lie above and extend alongside the noted first-layer log. Moreover, in some cases, the assembly will comprise a plurality of first-layer logs, a plurality of second-layer logs, and a plurality of third-layer logs, and each third-layer log will be held by at least two of the positioning apparatuses such that each third-layer log will be held by at least two of the positioning apparatuses so each third-layer log lies above and extends alongside an underlying first-layer log. Preferably, each support arm is provided with a wedge system that includes two converging surfaces defining a valley. In some cases, at least a desired one of the log-positioning apparatuses is configured such that, while a desired one of the logs is supportably received on a support arm of the desired log-positioning apparatus, a position of the desired log can be adjusted by moving the desired log in a lengthwise manner, a lateral manner, a vertical manner, or a rotational manner. This can be accomplished, for example, by using positioning devices having the adjustability features described herein, such as any one or more of the positioning apparatus embodiments described herein (e.g., with reference to FIGS. 1-4). In the present embodiments, at least some (such as a majority, or substantially all) of the logs preferably are naturally shaped logs.

Certain embodiments of the invention provide a method for building a structure. The method comprises providing an assembly that includes a plurality of logs. In the present embodiments, the logs are provided in a configuration (or "stack assembly") comprising: (a) a first-layer log held above ground; (b) a second-layer log held in a position wherein at least one end region of the second-layer log is disposed above the first-layer log; and (c) a third-layer log held in a position wherein at least one end region of the third-layer log is disposed above the second-layer log. Here, the first-layer log, second-layer log, and third-layer log are identified for being assembled together with other logs to produce a predetermined shell, the predetermined shell has a desired total number of layers of logs, and the noted configuration has at least one less layer of logs than this desired total number. For example, the desired total number preferably is four or more, and the configuration (e.g., at any given time) desirably has logs of no more than three layers. In the present embodiments, the method comprises: (i) determining final corner notch indicia for the noted second-layer log and determining long groove indicia for the noted third-layer log, and thereafter; (ii) removing the noted first-layer log from the configuration. In some of the present embodiments, the noted configuration has an uppermost layer of logs that (e.g., at any given time during the method) is close enough to the ground to allow a builder to scribe final notch and long groove lines on logs of the uppermost layer while standing on the ground. In some of the present embodiments, a bottom surface of the uppermost layer of logs is (e.g., at any given time during the method) no more than about 70 inches above the ground. In certain cases, the noted configuration has logs from only three layers (or less). Preferably, after removing the first-layer log from the configuration, the second-layer log defines at least part of a lowermost layer of the configuration. After removing the first-layer log from the configuration, the method may involve adjusting the configuration by moving the noted second-layer log and the noted third-layer log each to a lower elevation. Optionally, this adjusting of the configuration includes adjusting a plurality of log-positioning apparatuses, the log-positioning apparatuses are adjusted by causing vertical motion of support arms of the log-positioning apparatuses, and the support arms supportably receive respective bottom side regions of logs of the configuration. In those embodiments of the present method that involve positioning apparatuses, the apparatuses can be any one or more of the positioning apparatuses described herein (e.g., with reference to FIGS. 1-4). When provided, each of the log-positioning apparatuses can optionally comprise an adjustment shaft having a long axis, and the adjusting of the log-positioning apparatuses can involve rotating each adjustment shaft about its long axis, such that this rotation of each adjustment shaft causes the noted vertical motion of support arms. In some cases, the vertical motion of support arms involves downwardly moving support arms of at least a group of the log-positioning apparatuses. This vertical motion of support arms can advantageously involve moving support arms of at least a group of the log-positioning apparatuses simultaneously by a common increment. In some embodiments, the vertical motion of support arms is initiated by actuating one or more motors. For example, this vertical motion can, in some cases, be initiated by actuating a plurality of motors, and each log-positioning apparatus can optionally have a motor. The method can optionally comprise operating a controller to actuate one or some of the motors, optionally to simultaneously actuate at least a subset (e.g., some, at least half, substantially all, or all) of the motors. In some of the present embodiments, the method comprises adding a first-overlying-layer log to a top of the configuration, the first-overlying-layer log being added such that at least one end region of the first-overlying-layer log is disposed above a subjacent log that is part of the configuration. In some of these cases, the first-overlying-layer log is added to the top of the configuration after removing the noted first-layer log from the configuration. Optionally, the first-overlying-layer log is a fourth-layer log, the subjacent log is the noted third-layer log, this fourth-layer log is above and extends alongside the noted second-layer log, and the method further comprises: (1) determining final corner notch indicia for the noted third-layer log and determining long groove indicia for the noted fourth-layer log, and thereafter; (2) removing the noted second-layer log from the configuration. Optionally, the method can further comprise adding a fifth-layer log to a top of the configuration, the fifth-layer log being added such that at least one end region of the fifth-layer log is disposed above the fourth-layer log. When provided, the fifth-layer log can optionally be added to the top of the configuration after removing the noted second-layer log from the configuration. In one group of the present embodiments, the method involves a log-layer-removal repetition technique comprising a plurality of cycles, wherein each cycle includes removing a lowermost layer of logs from a bottom of the configuration whereafter logs remaining on the configuration are moved vertically downwardly (optionally at the same time, i.e., simultaneously). Each cycle can optionally include adding an uppermost layer of logs to a top of the configuration and scribing logs of at least one layer of the configuration. The log-layer-removal repetition technique, for example, can be a log-layer-addition/scribing/log-layer-removal/lowering technique and each cycle can include, in sequence: (1) adding an uppermost layer of logs to a top of the configuration; (2) scribing logs of at least one layer of the configuration; (3) the noted removal of a lowermost layer of logs from the bottom of the configuration; and (4) the noted movement of remaining logs vertically downwardly. Optionally, the repetition technique includes at least four cycles. Preferably, the cycles are continued until all logs of the desired total number of layers have been scribed.

Certain embodiments of the invention provide a method of building a structure. In the present embodiments, the method comprises: (a) providing a plurality of logs, each log having two end regions; (b) positioning a first layer of logs in a spaced-apart arrangement; (c) positioning a second layer of logs above the first layer of logs in a crosswise arrangement wherein each end region of each second-layer log rests above a first-layer log; (d) positioning a third layer of logs above the second layer of logs in a crosswise arrangement wherein each end region of each third-layer log rests above a second-layer log, each third-layer log lying above and extending alongside an adjacent first-layer log to define a pair of adjacent first-layer and third-layer logs, whereby a first gap is formed between each such pair of adjacent first-layer and third-layer logs, and wherein there are at least two first gaps. (The method embodiments described in the preceding paragraph, or the assembly embodiments of the paragraph before that, can optionally involve logs positioned in this cross-wise stack.) In the present embodiments, the method involves scribing long groove lines on 1st and 2nd of the third-layer logs, and a first long groove scriber setting is used for scribing the long groove lines on the 1st third-layer log while a second long groove scriber setting is used for scribing the long groove lines on the 2nd third-layer log. Here, the first and second long groove scriber settings are different. Further, in the present embodiments, at such time as the long groove line scribing is performed on the 1st and 2nd third-layer logs, at least one (optionally a plurality, substantially all, or even all) of the second-layer logs has not been cut so as to have final corner notches. In some of the present embodiments, the method comprises scribing final corner notch lines on both end regions of a selected log from one of the noted second and third layers, and one final notch scriber setting is used for scribing the final corner notch lines on one of the end regions of the selected log while a different final notch scriber setting is used for scribing the final corner notch lines on the other end region of the selected log. In some of the present embodiments, the logs define at least three walls, including first and second walls that form at their intersection a corner, the first wall includes a 1st second-layer log having left and right end regions, the right end region of the $1^{st}$ second-layer log is at the corner between the first and second walls, and the method comprises scribing final corner notch lines on the right end region of the 1st second-layer log using a first final notch scriber setting, the second wall includes the 1st third-layer log, the 1st third-layer log has right and left end regions, the left end region of the 1st third-layer log is at the corner between the first and second walls, and the method comprises scribing final corner notch lines on the left end region of the 1st third-layer log using a second final notch scriber setting, the second final notch scriber setting is at least substantially equal to the first long groove scriber setting less the first final notch scriber setting. Optionally, the logs define at least three walls, including second and third walls that form at their intersection a corner, the third wall includes a 2nd second-layer log having left and right end regions, the left end region of the 2nd second-layer log is at the corner between the second and third walls, the method comprises scribing final corner notch lines on the left end region of the 2nd second-layer log using a third final notch scriber setting, the method further comprises scribing final corner notch lines on the right end region of the 1st third-layer log using a fourth final notch scriber setting, the right end region of the 1st third-layer log is at the intersecting corner between the second and third walls, and the fourth final notch scriber setting is at least substantially equal to the first long groove scriber setting less the third final notch scriber setting. In some of these cases, the third wall and a fourth wall form at their intersection a corner, the fourth wall includes the 2nd third-layer log, the 2nd third-layer log has left and right end regions, the left end region of the $2^{nd}$ third-layer log is at the intersecting corner between the third and fourth walls, the method comprises scribing final corner notch lines on the right end region of the 2nd second-layer log using a fifth final notch scriber setting, the method further comprises scribing final corner notch lines on the left end region of the 2nd third-layer log using a sixth final notch scriber setting, and the sixth final notch scriber setting is at least substantially equal to the second long groove scriber setting less the fifth final notch scriber setting. Moreover, in some cases, the structure is a 4-wall structure, the fourth wall and the first wall form at their intersection a corner, the right end region of the 2nd third-layer log is at the corner between the fourth and first walls, the left end region of the 1st second-layer log is at the corner between the fourth and first walls, the method comprises scribing final corner notch lines on the left end region of the 1st second-layer log using a seventh final notch scriber setting, and the method further comprises scribing final corner notch lines on the right end region of the 2nd third-layer log using an eighth final notch scriber setting, and the eighth final notch scriber setting is at least substantially equal to the second long groove scriber setting less the seventh final notch scriber setting.

In some of the present embodiments, the logs define at least five walls, the fourth wall and a fifth wall form at their intersection a corner, the fifth wall includes a 3rd second-layer log having a left end region at the corner between the fourth and fifth walls, the method comprises scribing final corner notch lines on the left end region of the 3rd second-layer log using a seventh final notch scriber setting, the method further comprises scribing final corner notch lines on the right end region of the 2nd third-layer log using an eighth final notch scriber setting, and the eighth final notch scriber setting is at least substantially equal to the second long groove scriber setting less the seventh final notch scriber setting.

In certain of the present embodiments, the method involves arranging the logs so they define at least six walls. For example, in some such embodiments, the logs define at least six walls, including three first gaps, and wherein, with respect to the third-layer logs above these three first gaps, different long groove scriber settings are used on different logs to mark long groove scribe lines.

In some of the present embodiments, the method comprises providing a plurality of overlying layers of logs, the overlying layers are designated for final positioning in the structure above the third-layer logs, and, for the logs of the overlying layers, within a given layer, different long groove scriber settings are used on different logs to mark long groove scribe lines. Optionally, for such logs of overlying layers, the final notch scriber setting used on a right end region of each log is different than a final notch scriber setting used on a left end region of the same log.

In certain embodiments, the invention provides a method of building a structure. In the present embodiments, the method comprises: (a) providing a plurality of logs, each log having two end regions; (b) positioning a first layer of logs in a spaced-apart arrangement; (c) positioning a second layer of logs above the first layer of logs in a crosswise arrangement wherein each end region of each second-layer log rests above a first-layer log; (d) positioning a third layer of logs above the second layer of logs in a crosswise arrangement wherein each end region of each third-layer log rests above a second-layer log, each third-layer log lying above and extending alongside an adjacent first-layer log to define a pair of adjacent first-layer and third-layer logs, whereby a first gap is formed between each such pair of adjacent first-layer and third-layer logs, wherein there are at least two first gaps. In the present embodiments, the method comprises determining long groove indicia for 1st and 2nd of the third-layer logs. Here, a first long groove dimension setting is used for determining the long groove indicia for the 1st third-layer log and a second long groove dimension setting is used for determining the long groove indicia on the 2nd third-layer log, and these first and second long groove dimension settings are different. In the present embodiments, at such time as the long groove indicia determining is performed on the 1st and 2nd third-layer logs, at least one (e.g., a plurality, at least half, substantially all, or all) of the second-layer logs has not been cut so as to have final corner notches. In the present methods, the indicia can be scriber lines. However, they can alternatively or additionally be other indicia, such as shading, painting, chalking, or the like. Moreover, the indicia can be determined and stored remotely (i.e., not on the log), such as by a computer having a topographical model of the log where the model shows the areas of wood to be removed from the log. Many other types of indicia (taping the log to provide indicia, roughing the log to provide indicia, etc.) can be used in the present embodiments.

DETAILED DESCRIPTION OF PREFERRED EMBODIMENTS

Figure 1:
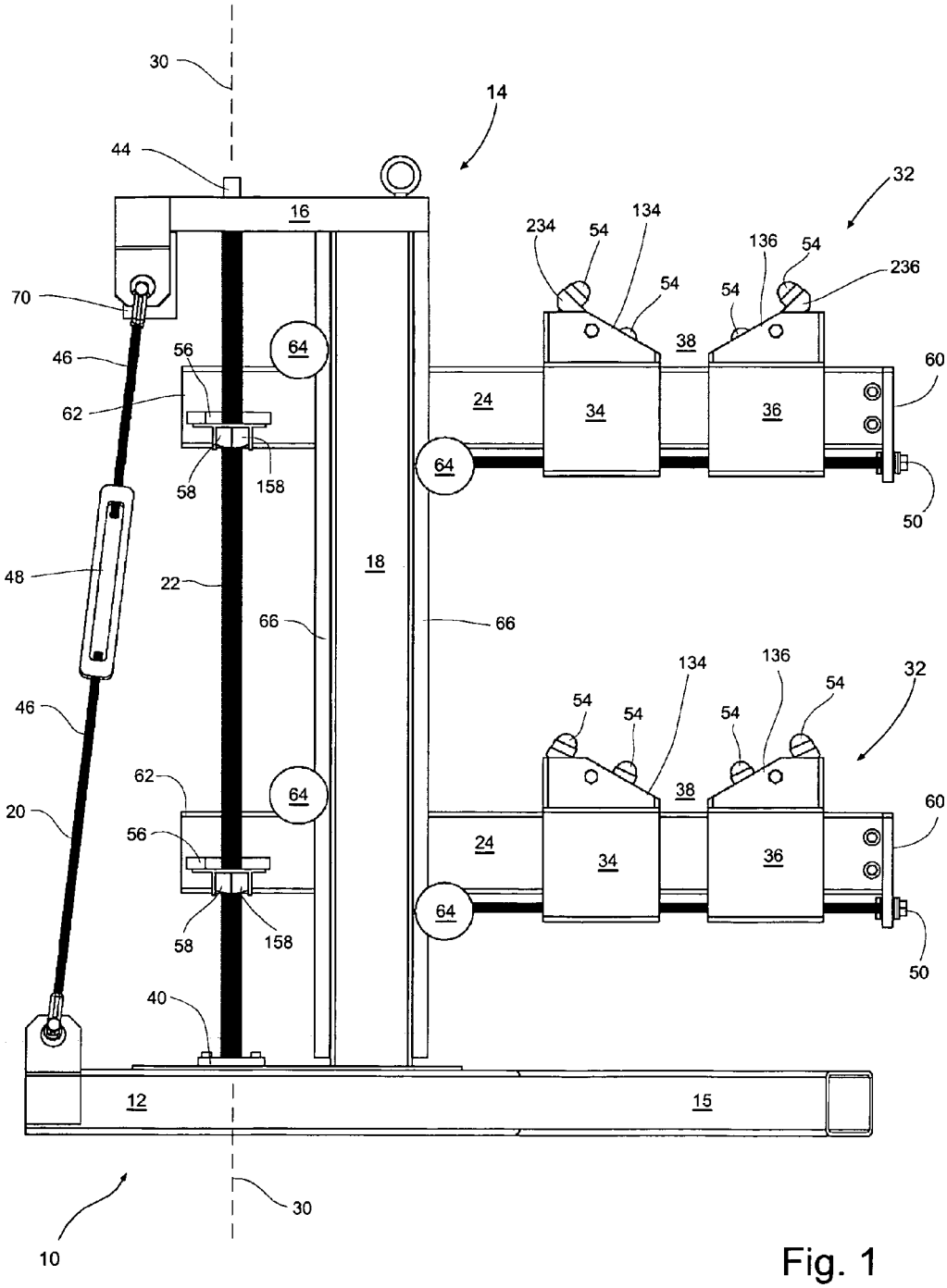
FIG. 1 shows a side profile of a log-positioning apparatus in an embodiment of the present invention.

The following discussion is presented to enable a person skilled in the art to make and use embodiments of the invention. Various modifications to the illustrated embodiments will be apparent to those skilled in the art given the present teaching as a guide, and the principles disclosed herein can be applied to many other embodiments. Thus, the invention is by no means limited to the preferred embodiments shown, but is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize that the examples provided herein have many useful alternatives that fall within the scope of the invention. The following introductory material is intended to familiarize the reader with the general nature, and some preferred embodiments, of the invention.

With reference to FIG. 1, there is shown a side profile of an exemplary apparatus for building log structures in accordance with certain embodiments of the present invention. The illustrated apparatus (also referred to as a "log-positioning apparatus" or "jig") 10 includes an adjustment shaft 22, a support arm 24 (optionally a plurality of support arms), and a frame 14. Here, the frame 14 includes a base 12, a top plate (or "cap") 16, a track post 18, and a weight support brace 20. It is to be appreciated, though, that many different frame designs can be used. For example, the top plate may be integral to the track plate in some embodiments. In other embodiments, the top plate may actually be omitted. The weight support brace can also be provided in many different forms (e.g., a single line may be used, rather than two lines). Still further, embodiments are anticipated where the weight support brace is omitted entirely.

Figure 3:
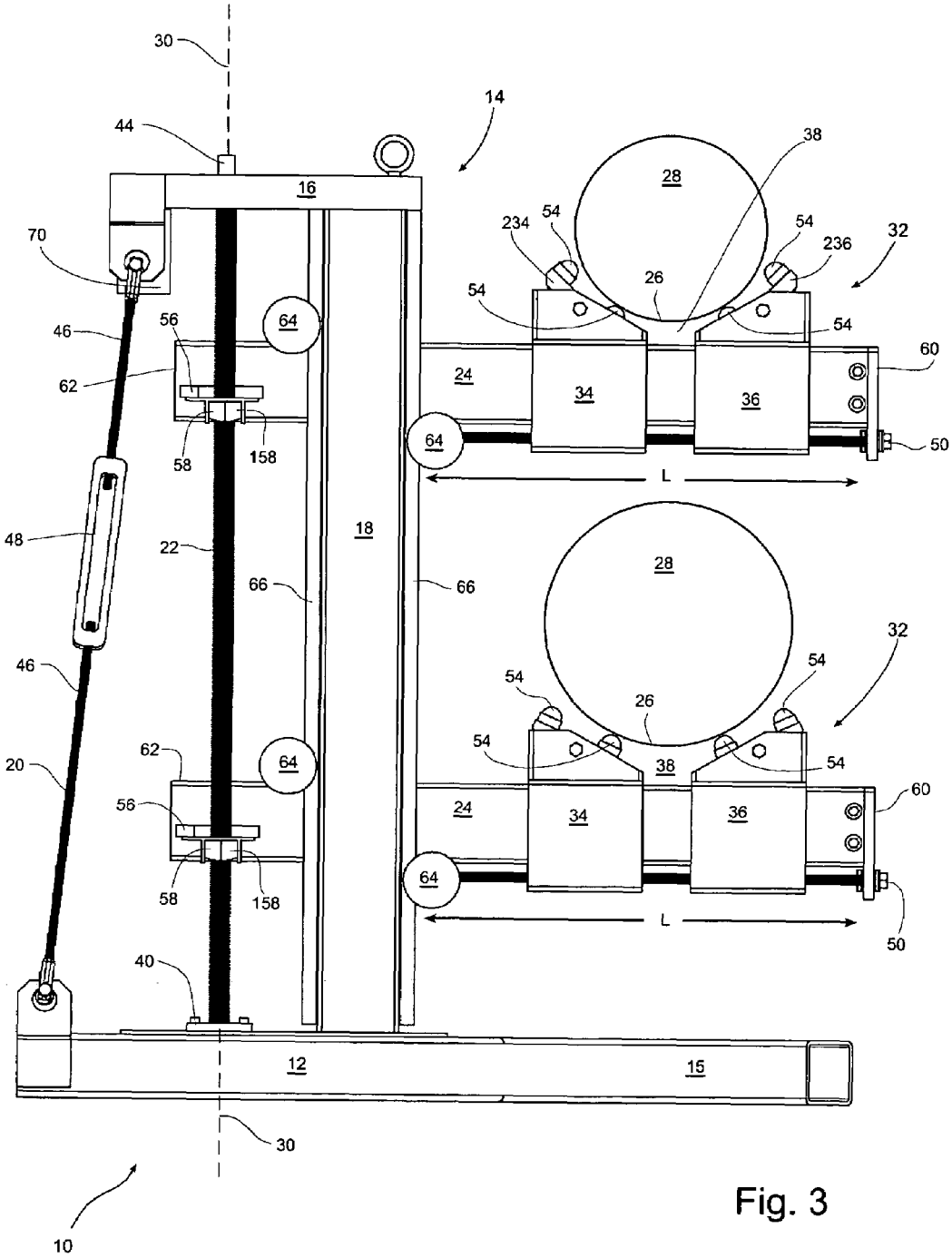
FIG. 3 shows a side profile of a log-positioning apparatus on which two logs are supported in accordance with certain embodiments of the present invention.

The support arm 24 is adapted to receive and support a bottom side region 26 of a log 28 (FIG. 3). Preferably, while a log 28 is supportably received on a support arm 24 (commonly a log will be supported by at least two support arms of different devices, although this need not always be the case), the position of the log 28 can be adjusted by moving the log in a lengthwise, lateral, vertical, or rotational manner, as discussed below in more detail. The position of the log preferably can be adjusted by moving the log in any of these manners while the log is fully supported on the support arm(s). With respect to adjusting the position of the log 28 in a vertical manner, this can be done without actually moving the entire support arm 24 to a higher or lower elevation.

The support arm 24, base 12, track post 18, and top plate 16 can be made of essentially any material that is sufficiently strong. In some embodiments, metal (e.g., steel) is used. Wood may also be suitable for one or more of these components. The materials used should be suitable for giving the apparatus enough strength to support the necessary weight.

Preferably the apparatus 10 is adapted to support at least about 30 pounds, at least about 60 pounds, at least about 200 pounds, at least about 1,000 pounds, or even at least about 3,000 pounds. While supporting a weight within any one or more of these ranges, the apparatus preferably functions (without jamming, binding, etc.) to allow its support arm(s) to move vertically (to adjust the vertical position of each log held by the apparatus).

The illustrated adjustment shaft 22 has exterior threads and an axis 30. The shaft 22 can be operably coupled to a support arm 24 such that the support arm 24 moves vertically in response to rotation of the adjustment shaft 22 about its axis 30 (discussed in more detail below). Alternatively, the support arm 24 could be adapted to move vertically in response to linear movement of the adjustment shaft along its axis. This linear movement could be actuated, for example, utilizing hydraulics to move the adjustment shaft 22 upward or downward.

Figure 2A:
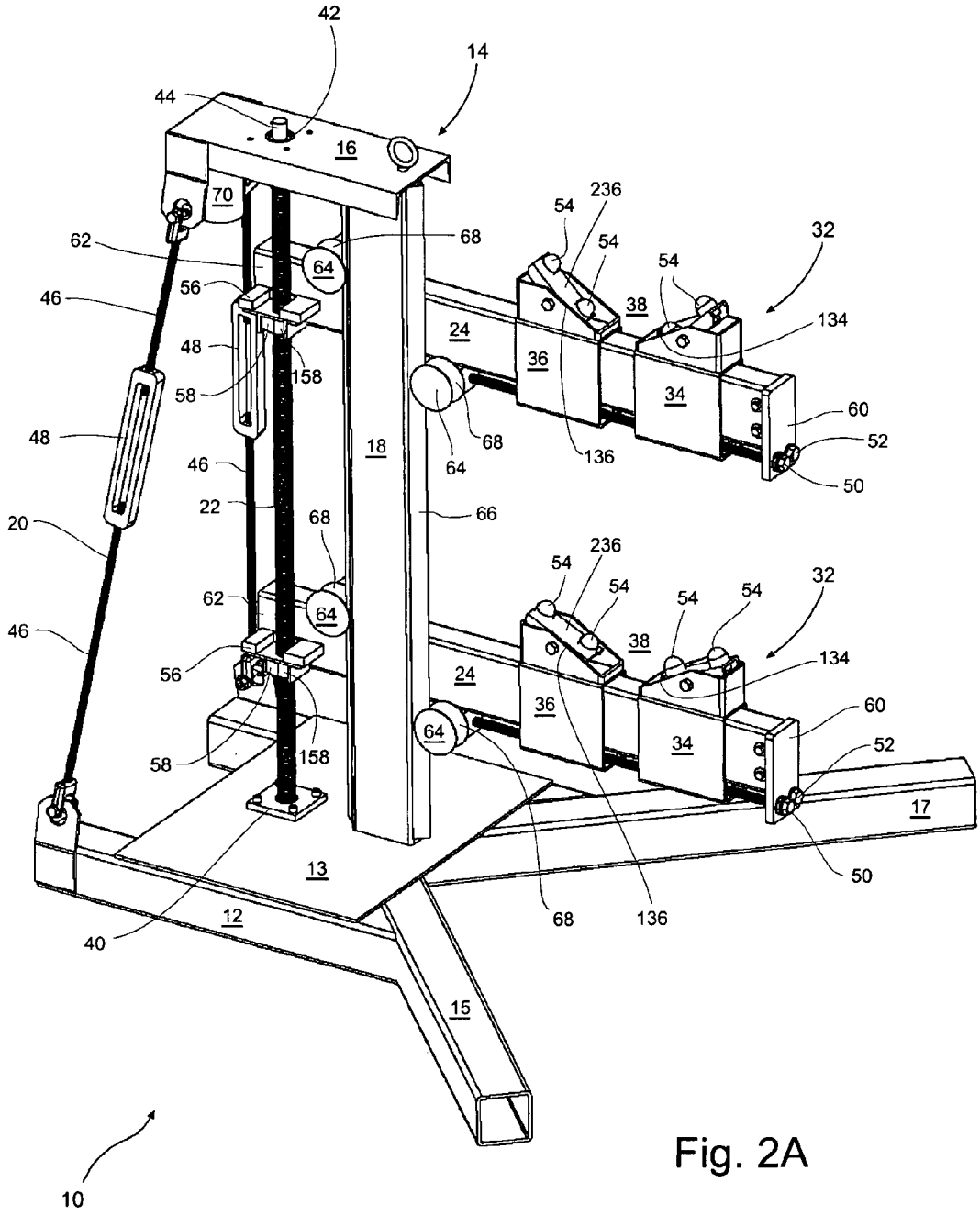
FIG. 2A shows a front auxiliary inclined view of a log-positioning apparatus in an embodiment of the present invention.
Figure 2B:
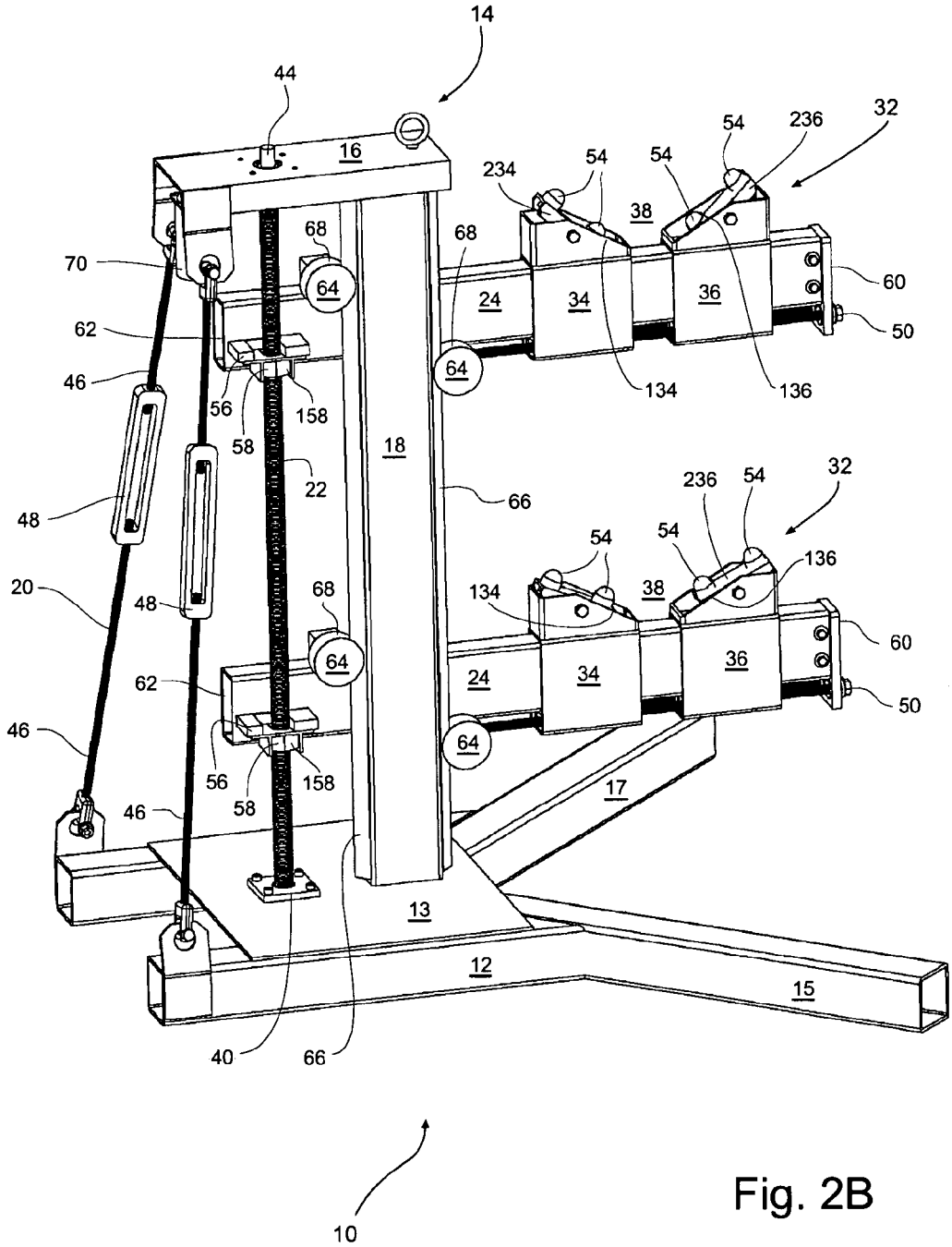
FIG. 2B shows a rear auxiliary inclined view of a log-positioning apparatus in an embodiment of the present invention.

With reference to FIGS. 2A and 2B, there are shown auxiliary inclined views of an apparatus 10 in an embodiment of the present invention. The bottom of the illustrated adjustment shaft 22 is secured to the base 12 in such a way that the shaft 22 has freedom to rotate about its axis. The shaft 22, for example, can be received in an aperture of a mounting bracket 40, which is bolted to a footing 13 of the base 12. This manner of anchoring the adjustment shaft 22 allows the shaft 22 to rotate freely, e.g., during lowering or raising of the support arm(s). The mounting bracket 40 can be secured to the base 12 in most any fashion without departing from the spirit of the invention. For example, the base 12 can be designed such that the footing 13 is integral to the rest of the base.

With continued reference to FIGS. 2A and 2B, the top end region of the illustrated adjustment shaft 22 is received in an aperture 42 defined by the top plate 16 of the apparatus 10. Here, the top-most length (which defines the top end) of the shaft projects upwardly from the aperture 42 to provide a rotation connection 44. The rotation connection 44 can be configured to mate with a crank handle for manual rotation of the shaft 22, or with a motor 70 for motorized rotation of the shaft 22. In one preferred embodiment, the motor is a stepper motor.

In the embodiments shown in FIGS. 1, 2A, 2B, and 3, a weight support brace 20 is mounted between the base 12 and the top plate 16. The weight support brace 20 can comprise, for example, threaded cables 46 connected by a turnbuckle 48. The weight support brace 20 acts to help support the apparatus 10 when one or more logs are placed on its support arm(s) 24. Logs, of course, are commonly heavy (commonly 60 to 3,000 pounds each). Thus, when a log is placed on a support arm 24, the apparatus must be able to support the weight of the log without tipping over, deforming excessively, or otherwise breaking. To counteract this weight, the support brace 20 works in combination with the top plate 16 and the base 12 to provide a weight brace on the backside of the apparatus 10. This tends to impart additional structural rigidity to the apparatus.

The base 12 can be positioned on the ground or another flooring surface (e.g., a floor deck) so as to provide a stable support for the apparatus 10. The illustrated base 12 has a square footing 13. However, the footing 13 can be provided in many other configurations. It may also be omitted in some embodiments. Preferably, the base 12 has legs 15 and 17 that provide a stable foundation for the apparatus 10. The illustrated legs 15, 17 extend outwardly (e.g., away from the footing 13) at approximately ninety degrees to each other. This configuration helps prevent the apparatus 10 from falling forward, or to either side, when a large weight from one or more logs 28 is held on the support arm(s) 24. The legs 15, 17 also help prevent the apparatus from sinking unacceptably when used on softer ground. It may be advantageous if the legs 15 and 17 are at least as long as (and/or extend at least as far from the post 18 as) the support arm(s) 24, so as to provide stability. The illustrated legs 15 and 17 extend outwardly from beneath the footing 13, although this is not required. In FIGS. 1, 2A, 2B, and 3, each leg 15, 17 extends in the same general direction as the support arm(s) 24. By this, it is meant that each leg 15, 17 extends along an axis that is offset by no more than about 90° (preferably no more than about 60°) from the axis along which the arm(s) 24 extend.

In FIGS. 1, 2A, 2B, and 3, the apparatus 10 is shown in a state where it is equipped with two support arms 24. Each apparatus 10 can include 1, 2, 3, 4, or more support arms. In embodiments involving an apparatus 10 with more than one support arm, these arms (when mounted operably on the apparatus 10) preferably are generally parallel to each other, and they preferably lie in a shared vertical plane (i.e., they preferably are aligned one directly above another). These features, however, are strictly optional.

With reference again to FIGS. 1, 2A, 2B and 3, it can be appreciated that each support arm 24 can advantageously have a wedge system 32 that includes two converging surfaces 134, 136 defining a valley 38, e.g., such that a bottom side region 26 of a log 28 can be disposed in the valley 38 (and cradled between the converging surfaces). The converging surfaces can optionally be defined by two wedge bodies 34 and 36, such that when a bottom side region 26 of a log 28 is disposed in the valley 38, the two wedge bodies 34, 36 cradle the bottom side region of the log. It is not necessary for the converging surfaces 134, 136 or the wedge bodies 34, 36 to be in direct contact with the cradled log.

Preferably, the wedge system 32 can be moved along a length L (FIG. 3) of the support arm 24 such that the valley 38 can be centered at different points along the length L of the arm 24. The wedge system 32, for example, can have a lateral-adjustment rod 50, which when rotated causes both wedge bodies 34 and 36 to move in unison (and in the same direction, and the same distance) along the length L of the support arm 24 (i.e., in a lateral direction). If the adjustment rod 50 is rotated in one direction (e.g., clockwise), the wedge bodies 34, 36 travel in a −X (X, Y, Z) direction, i.e., towards the track post 18, and if the rod 50 is rotated in the opposite direction (e.g., counterclockwise), the wedge bodies 34, 36 travel in a +X (X, Y, Z) direction, i.e., away from the track post 18. Preferably, the wedge bodies 34 and 36 have an internally threaded structure (not visible in the drawings) that engages the rod 50 and that is threaded in a common direction (and the entire threaded exterior of the rod 50 preferably is threaded in one single direction). Thus, whichever way the rod 50 is rotated, both wedge bodies 34 and 36 will move in the same direction, preferably at the same rate. This movement can be helpful for an operator who wishes to vertically line up two or more logs of a given wall. It is fully contemplated that the wedge system 32 could be moved along the length L of the support arm via hydraulic or pneumatic systems (and/or using a motorized system) without departing from the spirit of the present invention. It is also contemplated that one of the wedge bodies 34 and 36 could be moveable individually of the other without departing from the spirit of the invention.

The wedge system 32 preferably can be adjusted so as to move the wedge bodies 34 and 36 selectively closer together or further apart. Thus, when the bottom side region 26 of a log 28 is cradled by a pair of wedge bodies 34 and 36, the log 28 can be moved to a slightly higher elevation by moving the wedge bodies 34 and 36 closer together. The log 28 can also be moved to a slightly lower elevation by moving the wedge bodies 34 and 36 further apart. Here, the wedge system 32 can optionally use a height-adjustment rod 52 that can be rotated in first and second directions (e.g., clockwise and counterclockwise). Such a height-adjustment rod could be threaded in two different directions (e.g., clockwise from the middle to the left and counterclockwise from the middle and to the right). Further, each wedge body could have a internally threaded device (e.g., a nut) that matches the thread-direction of the height-adjustment rod passing through each wedge body. When rotated in the first direction, the wedge bodies 34 and 36 move towards each other, thus forcing the log 28 upward in a +Y direction (i.e., moving the log to a higher elevation). When rotated in the second direction, the wedge bodies 34 and 36 move away from each other, thus allowing the log 28 to move downward in a −Y direction, i.e., moving the log to a lower elevation (the limit, of course, being when the log 28 contacts the top wall of the support arm 24). This functionality allows the operator to vertically adjust the position (i.e., to change the elevation) of a log 28 without moving the whole support arm 24 up or down. Preferably, the wedge bodies are configured such that a log can be adjusted vertically by at least 4 inches, and perhaps optimally by at least about 6 inches, by simply moving the wedge bodies closer together or further apart. It is contemplated that the height-adjustment rod 52 could be replaced with (or actuated by) hydraulic or pneumatic systems (and/or a motorized system) without departing from the spirit of the invention.

With reference to FIG. 2A, it can be appreciated that the illustrated embodiment includes both a lateral-adjustment rod 50 and a height-adjustment rod 52. In this embodiment, both rods extend at least generally in parallel along a length of the support arm. Here, both rods 50, 52 are disposed on a bottom region of the support arm, although this is by no means required.

The wedge system 32 can optionally include at least one rotatable member 54. In some cases, the rotatable member facilitates moving a log 28 in a lengthwise manner (i.e., along a Z axis) while the log 28 is supported one or more arms 24 of the apparatus (e.g., while the log is cradled by wedge bodies 34 and 36). In such cases, the rotatable member 54 allows the log 28 to be moved in a +Z and −Z direction (e.g., out of or into the page, as seen in FIG. 3). The wedge system can also include at least one rotatable member 54 that facilitates rotating the log 28 about its Z or longitudinal axis (or "long axis") while the log 28 is cradled by wedge bodies 34 and 36 or otherwise supported by the arm(s) 24. In certain preferred embodiments, the wedge system includes at least one multi-directional rotatable member. Here, the multi-directional rotatable member desirably is adapted to rotate about two axes that are separated by about 90 degrees. This type of rotational member can optionally be a ball roller that can rotate in any direction, one such device is commonly known as a ball transfer. In such cases, the ball roller 54 preferably comprises a ball (optionally made of metal) that can rotate in any direction, e.g., on lubricated ball bearings beneath the ball. Each wedge body 34 and 36 can optionally have a plurality of multi-directional rotatable members 54. In the illustrated embodiments, the rotatable members 54 are adapted to contact a log 28 cradled by the wedge bodies 34 and 36. Thus, the position of the log 28 can be easily adjusted by rolling the log 28 on the ball rollers 54. This allows the builder to rotate the log 28 about its Z axis. It also allows a builder to move the log along its Z axis (i.e., lengthwise). It is contemplated that some or all of the multi-directional rotatable members 54 could be replaced with one or more single-axis rollers located on each wedge body, and/or with one or more wheels on each wedge body, without departing from the spirit of the invention.

As is perhaps best appreciated by referring to FIG. 3 in view of FIGS. 2A and 2B, a pivoting arm 234, 236 can optionally be provided on each wedge body 34, 36. These pivoting arms may be best seen in FIGS. 2A, 2B. It may be advantageous for two, or more, rotatable members 54 to be fixed to each pivoting arm 234 and 236. Each pivoting arm 234 and 236 is able to pivot about a horizontal axis (e.g., an axle or cap screw). Logs may have natural shapes including taper from a smaller diameter at one end to a larger diameter at the other end; may not be perfect circles in cross section; and may have knots, bumps and a variety of surface shapes, and so it can be advantageous to have the ability for the sub assemblies (such sub assemblies comprising pivoting arms 234 and 236) to independently tilt so that one or both rotatable members 54 of each sub assembly (e.g., on each pivoting arm 234 and 236) will contact the surface of log 26. Such an arrangement could make it possible for the weight of one end of a log to be shared by two or more rotatable members 54.

The support arm 24 preferably is mounted removably to the frame 14 of the apparatus 10. The illustrated support arm 24, when unloaded (i.e., not carrying a log), is adapted for being removed from the frame 14 by a removal technique that involves pivoting the support arm 24 (e.g., about a horizontal axis). The pivoting involves tilting the arms 24 from its normal horizontal position to a position where its distal end 60 is at a significantly higher elevation than its proximal end 62. The result of this pivoting/tilting is an increase in the horizontal distance between the two bearing members 64 of the tilted arm. This increased horizontal distance between the bearing members makes it possible to remove the arm from the track post (as described below in further detail).

In some embodiments, the support arm 24 is configured such that (when it is not carrying a log), it can be removed from the frame 14 and decoupled from the adjustment shaft 22 by a single-operator technique. In these embodiments, a single person can remove the support arm from the frame.

With respect to the embodiments illustrated in FIGS. 1, 2A, 2B and 3, when it is desired to remove one of the illustrated support arms 24 from the frame, an operator would remove the cap 56 from the split nut 58. The split nut 58 can optionally be a nut (with internal threads) that has been cut in half or is otherwise provided as two halves. Thus, when the operator wishes to remove the support arm 24, the operator would simply remove the cap 56 (which otherwise holds both sides of the split nut 58 together on the adjustment shaft 22), allowing the two sides of the nut 58 to separate, thus freeing the nut 58 from the shaft 22. The operator can then lift the distal end 60 of the support arm 24 (thereby pivoting the arm), causing the proximal end 62 of the arm 24 to be lowered somewhat towards the ground. In the illustrated embodiments, this pivoting action causes two bearing members 64 on the support arm 24 to release from a post 18 and/or track 66 of the frame. The support arm 24 can then be moved horizontally away from (i.e., downwardly into the page as seen by a viewer looking at FIG. 1) the adjustment shaft and post 18, so as to separate the arm 24 from the rest of the apparatus 10.

In some embodiments, and as illustrated in FIG. 3, split nut 58 may be cut into two halves, and one of the two halves affixed to support arm 24. For example, if the half nut and the support arm were metal (steel) then one half nut 158 could be welded to the support arm, though numerous other methods of fixing a half nut to the support arm are possible. The other half nut 58 could be removable from the support arm 24 and the shaft 22, and would be temporarily affixed by cap 56. An advantage to this embodiment is that a single-operator could install a support arm on the apparatus 14 and when half nut 158 engages the shaft 22, then the support arm it could support its own weight and not slide down tracks 66 or post 18. This could allow, for example, the operator to measure the elevation of support arm 24, and then to remove and reposition the support arm 24 if a higher or lower elevation were desired, without also requiring the operator to install the half nut 58 and cap 56 to keep the support arm 24 in place. The advantages of an arrangement whereby a newly installed support arm 24 would temporarily support its own weight on frame 14 and could therefore allow for easy single-operator adjustment of its initial elevation will not be further described.

In operation, the support arms in the illustrated embodiments can be lowered by rotating the adjustment shaft 22. In the illustrated embodiments, the jig has a plurality of support arms 24 that are adapted to move vertically (e.g., upwardly or downwardly along the frame) in response to rotation of the adjustment shaft 22. Preferably, all the arms 24 on the jig move downwardly in the same direction, at the same rate, and by the same distance in response to rotation of the shaft 22. As discussed above, the adjustment shaft 22 preferably has exterior threads and can be rotated by a manual hand crank, or a motor 70, that is coupled to the above-noted rotation connection 44. If a motor 70 is used on each apparatus 10 and a plurality of apparatuses 10 are provided in an assembly, then all the motors can advantageously be wired together (or wirelessly coupled) to a master control device (e.g., a controller having a switch) that can be actuated by an operator. When the operator wishes to simultaneously and uniformly rotate the adjustment shafts 22, the operator may press an on-button, an up-button or down-button, or the like, to start all the motors 70. The on-button may be held down until all the logs have reached their desired heights, at which point the operator could release the button, hence turning off the motors. In another embodiment, each of a plurality of adjustment shafts is connected at a rotation connection by a single chain. The chain can be driven by a motor or manually. By having all the adjustment shafts linked by a chain, each adjustment shaft can be rotated at the same time and rate, keeping the logs level and in the same position relative to logs above and below.

As the adjustment shaft 22 is rotated, the nut 58 will traverse downward, or upward as desired, along on the threads of the shaft 22.

To mount a support arm 24 on the apparatus 10, the arm 24 is tilted about a horizontal axis (as described above with respect to removing an arm 24 from the apparatus 10) so that the distal end 60 is pivoted above the proximal end 62. The bearing members 64 are then moved into position on opposite sides of the post 18, and the distal end 60 of the arm 24 is lowered to cause the bearing members 64 to engage the track 66. As shown in FIGS. 2A and 2B, the track 66 can optionally be V-shaped (e.g., having a V-shaped cross section) with the V-shape extending away from the post 18 (i.e., such that walls of the track converge with increasing distance from the post 18 until they come together at a corner). The illustrated V-shaped track 66 is adapted to receive the bearing members 64, e.g., such that when a bearing member is engaged with the track, the corner of the track extends into a channel 68 defined by the bearing member. The walls of the channel 68 help prevent the bearing members 64 (and thus the support arm 24) from coming off the frame when a log is being moved lengthwise on the apparatus. In one embodiment, channel 68 and bearing member 64 are combined into one part, for example a V-channeled roller wheel. The two half nuts 58, 158 are secured about the adjustment shaft 22, and the cap 56 is placed over the two nut halves 58, 158, thus securing the two nut halves 58, 158 to the shaft 22.

The illustrated bearing members 64 on each support arm 24 engage the track 66 at different elevations, as shown in FIGS. 1 and 3. Here, the bearing member 64 nearest the distal end 60 of the support arm 24 has the lowest elevation. The bearing member 64 nearest the proximal end 62 of the arm 24 has the highest elevation. Thus, the bearing members 64 engage opposite sides of the post 18, and they engage the post 18 at different elevations. Thus, the design of the support arm here involves both a lower bearing member 64 and an upper bearing member 64. Preferably, the lower bearing member is mounted adjacent to a bottom region of the arm, while the upper bearing member is mounted adjacent to a top region of the arm. In other embodiments, these preferred features may not be present.

The bearing members 64 shown in FIGS. 1, 2A, 2B and 3 are wheel-like bearing members with V-channel rollers. Many different types of wheel-like bearing members can be used, for example, if the bearing members in FIG. 4 are not V-channel rollers.

Figure 4:
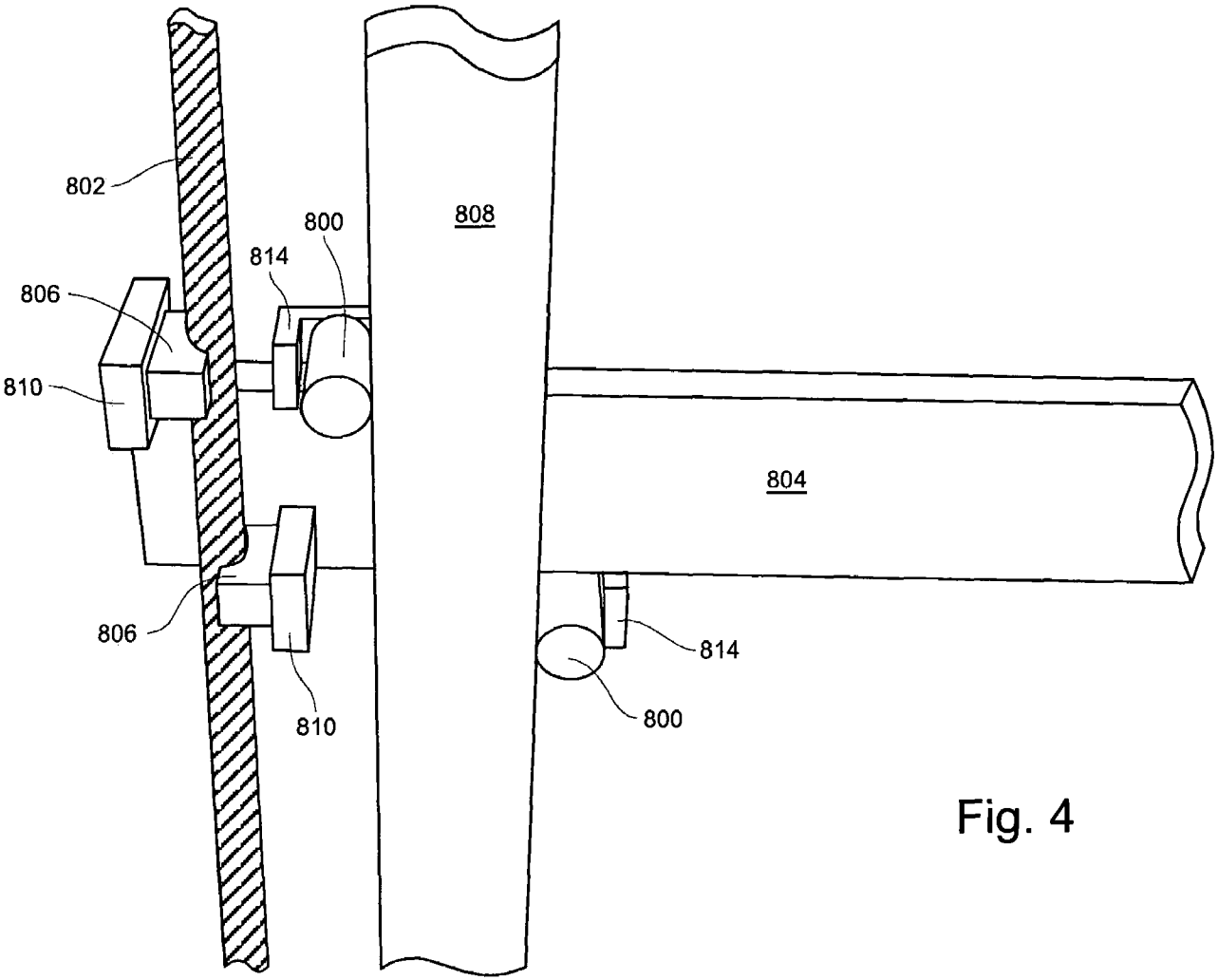
FIG. 4 shows a broken-away, side auxiliary inclined view of a coupling between an adjustment shaft and a support arm of a log-positioning apparatus in an embodiment of the present invention.

With reference to FIG. 4, there is shown perspective view of a coupling between an adjustment shaft and a support arm in accordance with certain embodiments. As shown, rollers 800 (optionally metal rollers) are used as the bearing members 64. The rollers 800 act to grip the post 808, thus stabilizing the support arm 804. The rollers may each comprise a roller, rotatable ball, etc. that engages the post 808. Alternatively, the roller could simply have a face that skids/slides along the post. Here, the rollers 800 are fixed to support arm 804 with mounting flanges 814.

When the adjustment shaft 802 is rotated, the rollers 800 allow the support arm 804 to move in a vertical direction. Once the adjustment shaft 802 stops rotating, the rollers 800 (as well as the split-nuts 806 engaging the adjustment shaft) hold the support arm 804 in place. It is fully contemplated that many different devices and materials can be used for the bearing members 64, such as blocks of wood, low-friction pads, rollers (e.g., cylindrical rollers, V-channel rollers), or any other material that would hold the support arm 804 against the post 808, while still allowing the support arm 804 to move vertically when the adjustment shaft 802 is rotated.

With continued reference to FIG. 4, this embodiment provides a shaft/arm coupling comprising two partial nuts 806. Here, each partial nut 806 has internal threads that align with external threads on the adjustment shaft 802. When attaching the support arm 804 to the post 808, the support arm 804 is tilted (in the same manner discussed above) such that the rollers 800 can be moved into position on opposite sides of the post 808. The support arm 804 is then tilted back to horizontal, so as to engage the rollers 800 with the post 808. In this process, the partial nuts 806 are snapped securely onto the adjustment shaft 802. The weight of the support arm 804 and/or log(s) holds the partial nuts 806 with pressure against the adjustment shaft 802. When the adjustment shaft 802 is rotated, the engagement of the external threads on the shaft 802 with the internal threads of the partial nut 806 causes the support arm 804 to move in a vertical direction.

With continued reference to the embodiment of FIG. 4, each partial nut is fastened to a mounting block 810. Mounting block 810 is fastened to support arm 804. The lower partial nut 806 and mounting block 810 may be positioned at an elevation below the upper roller 800. In one preferable embodiment, the upper partial nut 806 and mounting block 810 may be positioned at an elevation at or above the upper roller 800. Tilting support arm 804 away from horizontal, so that its right end is at a higher elevation than its left end (i.e., "left" and "right" as seen in FIG. 4), tends to disengage both lower split nut 806 and upper split nut 806 from the threads of the adjustment shaft 802, thus allowing for support arm 804 to be removed from post 808.

Certain embodiments of the invention provide an assembly that includes a plurality of logs and a plurality of log-positioning apparatuses. In some cases, the assembly includes at least eight log-positioning apparatuses (and/or at least two on each wall of the assembly), although this is by no means required. Preferably, the log-positioning apparatuses each comprise a support arm that can be moved vertically so as to raise or lower at least a portion of once of the logs (e.g., such that when these support arms are lowered, the logs they carry are thereby lowered or raised, as desired). Optionally, the support arms of the apparatuses are adapted for being simultaneously moved vertically by a common increment in response to operation of one or more motors. If desired, the present assembly can include some positioning apparatuses having vertically moveable support arms and other positioning apparatuses that do not have this feature. In the present assembly embodiments, bottom side regions of the logs preferably are supportably received on the support arms of respective ones of the log-positioning apparatuses. Thus, the logs can optionally be supported from below by the apparatuses, rather than having attachments secured to the ends of the logs. FIGS. 5-10 depict exemplary assembly embodiments.

The present assembly embodiments (as well as the method embodiments of the invention) generally include a first-layer log held above ground, a second-layer log held in a position wherein at least one end region of the second-layer log is disposed above the first-layer log, and a third-layer log held in a position wherein at least one end region of the third-layer log is disposed above the second-layer log. As described below, the assembly will commonly include a plurality of logs of each layer. However, this is not strictly required.

In addition to assembly embodiments, the invention provides a first group of method embodiments that involves processing logs provided in a particular configuration (or "stack assembly"). Here, the stack assembly optionally includes a plurality of log-positioning apparatuses. Further, the invention provides a second group of method embodiments wherein two different scriber settings are used respectively for scribing long groove lines on two different logs of the same layer. The invention also provides certain method embodiments that combine the aspects of both the first and second groups of method embodiments.

Log structures of the present invention are built using a plurality of logs wherein each log has a first end region and a second end region. The first and second end regions are respectively adjacent to the first and second ends of each log. A span extends longitudinally between the first and second ends of each log.

Log structures (and the present stack assembly) may be preferably comprised of a crosswise stack of logs wherein the long axis of each log is generally or substantially horizontal. The end regions of consecutive layers of logs may intersect (e.g., at corner notches). A plurality of such intersecting end regions in a substantially vertical, crosswise grouping is a "log corner," or "corner."

The present invention can be used quite advantageously to build log structures using naturally shaped logs. It is to be understood that a log will be referred to herein as "naturally shaped" if it has substantially the same shape as the tree from which it came. Most naturally shaped logs are tapered, and have a small end (or a "tip") and a large end (or a "butt"). Accordingly, discussion herein typifies use of the present invention to build structures using logs that have a small end and a large end. However, the present invention could also be used to build structures with naturally shaped logs that have little or no taper. Moreover, the assembly and method embodiments of the invention can optionally involve (e.g., some or all) logs that are not naturally shaped (e.g., logs milled or otherwise formed to have a common shape could be used alone or in combination with naturally-shaped logs).

The bark is commonly removed from each log before construction begins. This may be accomplished by hand or by machine. If desired, the logs may also be sanded or otherwise prepared.

Structures can be built according to the present invention using logs with any diameter. Logs having a diameter of at least 10 inches at their small end give excellent results for many structures. However, smaller logs would also give acceptable results. Particularly desirable results have been achieved using logs with an average diameter of 14 inches or more. The selection of logs may also be based on the personal preference of the builder or client. For example, some people may prefer logs that have unusually small diameters, while others may prefer logs with unusually large diameters. In any event, selecting a set of logs that will be suitable for a particular structure is well within the capability of those skilled in the art of designing or building log structures.

With respect to the above-noted first group of method embodiments, the stack assembly preferably has at least one less layer of logs than will ultimately be in the structure being built. With the first, second, and third-layer logs maintained in the noted configuration, final corner notch indicia are determined for the second-layer log and long groove indicia are determined for the third-layer log. Thereafter, the first-layer log may be removed from the configuration/stack assembly. In some cases, after removing the first-layer log from the stack assembly, the second-layer log defines at least part of a lowermost layer of the stack assembly. Exemplary methods of this nature are described below in more detail.

A first layer of logs preferably is held by devices (which in some cases support the end regions of each log), and the first-layer logs preferably are positioned in a spaced-apart configuration. It is to be understood that the term "first layer" will be used herein to refer to the first layer of logs that is added to a structure in accordance with the present invention. As would be obvious to those skilled in the art of log building, one could begin to practice the present invention at any layer in a structure. For example, the bottommost three layers in a structure could be constructed using the traditional method of log-by-log building, whereafter additional layers could be constructed according to the present invention. Likewise, the bottom story of a structure could be built using traditional methods, while an upper story could be built according to the present invention. A great many variations of this nature would be obvious to those of skill in the instant art, and would fall within the scope of this invention. Thus, in the present detailed description section, and in the claims, terms like "first-layer log" and "second-layer log" are used to refer to logs of any two adjacent layers (i.e., consecutive layers), but not necessarily the lowermost layers in the shell.

In most cases, it will be optimal to build an entire structure according to the present invention. Accordingly, discussion herein will typify construction of a log structure wherein all of the layers are added in accordance with the present invention.

The invention could be practiced with only one first-layer log, for example if the present method were used to build a simple corner structure (e.g., a structure that has either two walls or three walls, but not four walls), then there could be simply one first-layer log. Thus, the present assembly embodiments may only involve a single first-layer log, which preferably would be held above ground.

Figure 5:
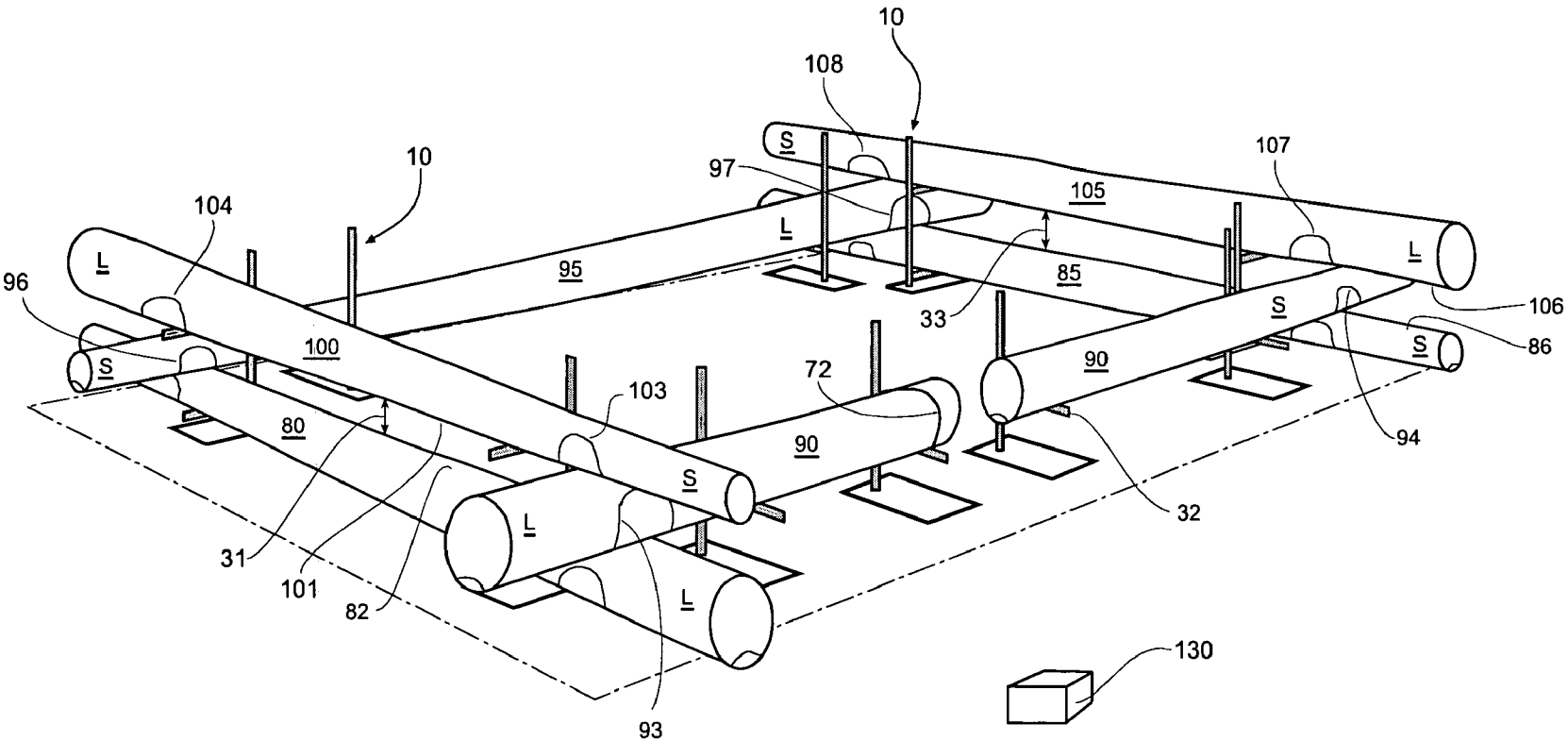
FIG. 5 shows a front inclined view of an assembly of apparatuses and logs in an embodiment of the present invention.

More commonly, a plurality of first-layer logs will be positioned in a spaced-apart configuration that reflects the particular design of the structure being built. An infinite variety of differently laid out structures can be built according to the present invention. Consequently, the first-layer logs may be positioned in a great number of different spaced-apart configurations. In many cases, the first-layer logs will be arranged in a spaced-apart configuration wherein at least one pair of spaced-apart logs are generally parallel. For example, FIG. 5 shows a stack of logs that illustrates a simple four-walled log structure. The illustrated structure comprises two generally parallel first-layer logs 80, 85. However, a structure need not have any first-layer logs that are parallel to one another. Those skilled in the art would be able to readily determine the positioning of each first-layer log according to the desired layout for a particular structure.

In one aspect of the present invention, the first-layer logs are arranged in a configuration wherein at least one pair of first-layer logs are spaced apart in a generally-opposed configuration with their small and large ends inversely oriented. This would commonly be desirable where a pair of first-layer logs will form walls on opposite sides of a structure being built. For example, FIG. 5 illustrates a configuration wherein two first-layer logs 80, 85 that will form walls on opposite sides of a structure, have their small S and large L ends inversely oriented. The logs of each such generally-opposed pair preferably have their small S and large L ends inversely oriented. This reflects a positioning pattern wherein parallel logs in the same layer have their small and large ends inversely oriented—that is, with the taper of such logs facing generally opposite directions. However, this is certainly not a requirement. For example, many builders position parallel logs in the same layer such that their small ends face one direction and their large ends face an inverse direction. Variations of this nature would be obvious to those skilled in the art of designing and building log structures. Moreover, it is to be understood that the present invention can be practiced without orienting the small and large ends of the logs in any particular manner. However, as would be obvious to skilled artisans, such orientations can be used advantageously to construct walls that are approximately level.

The present assembly and method embodiments preferably comprise a second-layer log held in a position wherein at least one end region of the second-layer log is disposed above (e.g., directly above and/or being in the same vertical axis as) a first-layer log. The invention could be practiced with only one second-layer log, for example if the present method were used to build a simple corner structure (e.g., a structure that has either two walls or three walls, but not four walls), then there could be simply one second-layer log. In many embodiments, however, there will be a plurality of second-layer logs positioned in a spaced-apart configuration, and the following discussion will focus on embodiments that have more than one second-layer log.

Preferably a second layer of logs is positioned in a crosswise stack above the first layer of logs. The second layer is positioned such that each end region of each second-layer log rests above (e.g., directly above and/or being in the same vertical axis as) a first-layer log. For example, the four-walled structure illustrated in FIG. 5 shows two second-layer logs 90, 95 positioned above two first-layer logs 80, 85 in a crosswise stack wherein each end region of each second-layer log is positioned above an end region of a first-layer log. Each end region of each second-layer log need not be contiguous with (that is, touching) the first-layer log below. Moreover, the second-layer logs are preferably not directly supported by (at least not only by) first-layer logs, though in alternative embodiments such logs could be touching.

In one aspect of the present invention, one or more second-layer logs are held by positioning devices that support respective bottom side regions of the log(s). For example, the second-layer logs may be held in position by devices, such as the apparatuses described above. Thus, the present assembly and method embodiments can involve one or more positioning devices in accordance with any embodiment described above in reference to FIGS. 1-4. Moreover, many other types of positioning apparatuses can be used in the present method and assembly embodiments. Thus, in FIGS. 5-8 and 10, the positioning apparatuses are shown in schematic form. It may be desirable (once a given second-layer log is placed on one, two, or more positioning apparatuses) to raise (or lower) one or both ends of certain second-layer logs. Logs held by such devices preferably can be moved vertically and horizontally to allow the position of each second-layer log to be adjusted. Likewise, the second-layer logs held by such devices preferably can be rotated about the longitudinal axis of each log to orient the log as desired. The unique contour of naturally-shaped logs commonly makes it desirable to orient bowed logs in certain ways, as will be appreciated by skilled artisans.

Thus, it may be advantageous to rotate certain second-layer logs around their long axis. Preferably, the positioning apparatuses are adapted to provide this functionality. For example, the positioning apparatuses can have rotatable members 54 of the nature described above. When provided, the rotatable members 54 (optionally like those shown in FIGS. 2A, 2B, and 3) can be used to position (e.g., to fine tune, or "adjust," the positions of) respective second-layer logs. Rotatable members 54 preferably are also adapted to facilitate positioning a second-layer log lengthwise. Such features of apparatus 10 allow the operator to adjust the position of each log (as it is added to the stacked assembly), e.g., rotationally or longitudinally.

It is preferable that the end regions of the second-layer logs not be positioned above, or on, the very end of a first-layer log(as would provide no log extensions). In some cases, such positioning will not provide sufficiently stable seating for the second-layer logs, and, moreover, in many cases the client or builder may desire the distinctive appearance that is achieved by structures that have such log extensions (or "flyways"). However, as would be obvious to those of skill in the art of log building, log extensions would not be required where certain types of notches are used. For example, a notch style that is commonly referred to as a "dovetail" notch has interlocking angled surfaces and can be used without log extensions.

Builders can use the present invention to construct an infinite variety of differently laid-out structures. Consequently, the second layer of logs can be arranged in a great many ways. With reference to the design of a particular structure, the general positioning of each second-layer log would be obvious to those skilled in the art of building or designing log structures.

In many cases, it will be desirable to arrange the second layer of logs such that at least one pair of second-layer logs 90, 95 are spaced-apart in a generally parallel configuration. For example, the configuration shown in FIG. 5 comprises two spaced-apart second-layer logs that are generally parallel to one another. However, it is not necessary that any of the second-layer logs be parallel to one another.

In one aspect of the present invention, the second-layer logs are arranged in a configuration wherein at least one pair of second-layer logs are spaced apart in a generally-opposed configuration with their small and large ends inversely oriented. Commonly, this would be desirable where a pair of spaced-apart second-layer logs will form walls on opposite sides of a structure. For example, FIG. 5 illustrates one such configuration wherein a pair of second-layer logs 90, 95 will form walls on opposite sides of a structure. Here, the reference character "L" identifies a large end of each log, and the reference character "S" identifies a small end of each log.

This orientation of second-layer logs reflects a common positioning pattern wherein the parallel logs in the same layer have their small and large ends facing opposite directions. As was discussed above with reference to the orientation of the first-layer logs, many builders position the parallel logs in the same layer such that their small and large ends face the same direction. Variations of this nature would be obvious to those skilled in the art of log building. Furthermore, skilled artisans in the instant field would recognize that the present invention can be practiced without orienting the small and large ends of the logs in any particular manner. However, as would be obvious to those skilled in the art of log building, such orientations can be used advantageously to construct walls.

With reference to FIG. 5, there is shown an exemplary assembly (or "stack assembly") for building log structures in accordance with certain embodiments of the present invention. The illustrated assembly includes a plurality of positioning apparatuses 10 at spaced-apart locations. Each apparatus 10 has been placed at a location that is convenient for holding logs to construct the walls of a log building of a given size and shape. Further, the apparatuses are advantageously arranged and configured to hold logs of three sequential layers of a log building. Log 80 and log 85 form a first layer of logs; log 90 and log 95 form a second layer; and log 100 and log 105 form a third layer of logs. Many other configurations could be used to build the log walls for a building of an alternate size, shape, and/or more than four walls. Moreover, the positioning apparatuses can be located at different locations (and/or a different number of these apparatuses can be used) in building the wall configuration shown.

The apparatuses can be supported on any surface adequate to support the weights and forces that will be applied to them. One effective floor would be made of concrete, but other types of floors would also be suitable.

Second-layer log 90 appears in FIG. 5 in two parts, a left part and a right part, and the space between the proximal (i.e., confronting) ends of log 90 would be a common location for a door or a window opening in the wall of a completed log structure. It is a common practice to use log parts on the sides of such wall openings, and this technique is known to skilled artisans. Thus, in certain embodiments, the stack assembly includes at least one log that is provided in parts, and at least four positioning devices hold the collective parts of that log. The method and assembly described herein can be practiced with either full-length logs, or with logs in parts, or with any number of combinations of full-length logs and logs in parts, or partial logs.

For purposes of this disclosure, the terms "right" and "left" are as seen looking toward the wall or log in question from a vantage point outside (as opposed to inside) the shell directly in front of the wall or log in question.

With continued reference to FIG. 5, two apparatuses hold each log or each log piece. In the present assembly and method embodiments, this will commonly be a preferred feature. Each apparatus 10 preferably is located so as to provide operator access to certain portions of the logs, such as to each of the log wall intersections (e.g., corners). It is advantageous to provide the operator with suitable access to portions of some logs for tasks such as scribing (discussed below), and other tasks that would be obvious to skilled artisans.

More, or fewer, than two apparatuses per log could be used in an assembly. For example, a long log, that might sag under its own weight if supported only by the arms of two different apparatuses (in which each apparatus is near a distal end of such log), could be additionally supported by a third apparatus positioned at a convenient location closer to mid-span of the length of the given log. Three, or more, apparatuses could be used to support one log, if so desired.

Preferably, the apparatuses 10 of the present assembly collectively hold first-layer log 80 and log 85, second-layer log 90 and log 95, and third-layer log 100 and log 105. Each first-layer log 80, 85 would be placed onto a support arm assembly (e.g., onto one or more support arms) 32 of the apparatuses 10. Preferably, each end region of log 80 and log 85 would then be manipulated laterally, vertically, lengthwise, and rotated around its long axis until the desired position for that log is obtained.

Thereafter, the logs 80, 85 could be fixed in such desired position so as to reasonably restrict unwanted additional movement (e.g., so as to prevent any substantial movement of each log relative to the device arm(s) holding it). Here, an anchoring device (or "fastener") 73 preferably is provided for each log of the assembly (or at least for each log held by the positioning devices). One such anchoring device comprises a chain and lever arm to tighten the chain. Such a device would assist in limiting a log from undesirable movement such as rotation, or lengthwise motion in a direction along the long axis of the log (such movements being relative to the arm(s) 32 supporting such log). As is obvious to those skilled in the art, it can be desirable to prevent unwanted movement of logs that are being scribed. Numerous other methods of fixing are possible, as are other devices that could be used to restrict or limit undesired movement of log position and orientation after a log has been manipulated to the desired position.

Thus, in certain method embodiments, the method includes positioning one log (or each of a plurality of logs) onto a positioning device, and then adjusting the position (or "orientation") of the log on the device, optionally followed by securing the log to the device (e.g., using one or more fasteners).

In one preferred embodiment, with the first-layer log 80 and log 85 in the desired positions, and having been fixed to the arms supporting each log, then second-layer log 90 and log 95 are placed onto arm assemblies (e.g., onto one or more support arms) 32 of apparatuses 10. Here, the second-layer logs are positioned on different ones of the apparatuses than the first-layer logs, although this is not strictly required. FIG. 5 shows two second-layer logs 90, 95 positioned above two first-layer logs 80, 85 in a crosswise stack wherein each end region of each second-layer log is positioned above one end region of a first-layer log. Each end region of each second-layer log need not be contiguous with (that is, touching) the first-layer log below. Moreover, the second-layer logs are preferably not directly supported by first-layer logs, though in alternative embodiments such logs could be touching.

As noted above, it may be advantageous to raise (or lower) one or both ends of certain second-layer logs. Preferably, the positioning apparatuses are adapted to provide this functionality. For example, the positioning apparatuses can have height-adjustment rods 52 of the nature described above. In such cases, the height-adjustment rod 52 (optionally like that shown in FIG. 2A) can be adjusted by an operator (e.g., manually). Furthermore, the positioning apparatuses preferably are adapted to facilitate positioning a log laterally. For example, the positioning apparatuses can have lateral-adjustment rods 50 of the nature described above. The lateral-adjustment rods 50 (optionally like those shown in FIGS. 1-3) can be used to laterally position respective second-layer logs. Such features of apparatus 10 allow the operator to adjust the position of each log (as it is added to the stacked assembly), e.g., vertically and/or laterally.

Rough notches can optionally be used at various stages during the building process to accomplish a variety of goals. These goals typically include: making the gap between adjacent pairs of logs more uniform; separating vertically adjacent pairs of logs by a gap of a certain vertical dimension; reducing scriber settings by bringing two adjacent logs closer together and so reducing the height of the gap between them; and providing for making certain logs or portions of logs horizontal or level. Since these possibilities are well known to those skilled in the relevant art, they will not be discussed in further detail. Furthermore, the present invention can be practiced without using any rough notches. However, rough notches can be used advantageously in many ways when building structures according to the present invention. Thus, some assembly and method embodiments involve logs being provided with rough notches. This can be appreciated by referring to the exemplary embodiment of FIG. 10.

If desired, logs 90 can be rough-notched at one end region, or both end regions, or not rough-notched at all. Rough notches can be cut, or not cut, in any log, and in any layer, and in either end of a log, in both ends, or in neither end.

In the present assembly and method embodiments, a third-layer log preferably is held (and/or maintained and/or provided) in a position wherein at least one end region of the third-layer log is disposed above (e.g., directly above and/or being in the same vertical axis as) a second-layer log. The invention could be practiced with only one third-layer log, for example if the present method were used to build a simple corner structure (e.g., a structure that has either two walls or three walls, but not four walls), then there could be simply one third-layer log. In many embodiments, however, there will be a plurality of third-layer logs positioned in a spaced-apart configuration, and the following discussion will focus on embodiments that have more than one third-layer log.

Preferably, a third-layer of logs is positioned in a crosswise stack above the second-layer of logs. The third layer preferably is positioned such that each end region of each third-layer log rests above a second-layer log. Commonly, the third-layer of logs is positioned such that each end region of each third-layer log does not rest on a second-layer log. For example, the third-layer logs 100, 105 illustrated in FIG. 5 are positioned such that each end region of each third-layer log is above (e.g., directly above and/or being in the same vertical axis as) one end region of a second-layer log 90, 95.

It may be advantageous (once a given third-layer log is placed on one, two, or more positioning apparatuses) to raise or to lower one or both ends of each third-layer log. In such cases, one or more height-adjustment rods can be adjusted by the operator. Furthermore, one or more lateral-adjustment rod(s), or the like, can be used to position each third-layer log laterally. As discussed above for second-layer logs, such features of apparatus 10 allow the operator to adjust the position of each third-layer log as it is added to the stacked assembly: vertically and/or laterally.

Builders commonly orient logs that are curved or bowed (or have "sweep") in certain ways. In addition, it is common practice to adjust the position of each log so that its bottom side region is approximately parallel to the top region of the log below. It should be noted that other log-positioning goals are also typical in the log building art. With reference to FIG. 5, it may also be advantageous to position log 100 in a manner whereby it lies in a shared, generally vertical plane with log 80. After logs 100 and 105 have been manipulated into their desired positions, it is advantageous to fix each log to its support arms as described above, in order to reduce unwanted movement of a log.

Each third-layer log preferably lies above and extends alongside an adjacent first-layer log to define a pair of adjacent first-layer and third-layer logs. For example, in the structure illustrated in FIG. 5, log 80 and log 100 form an adjacent pair of first-layer and third-layer logs; and log 85 and log 105 form another such pair. In most cases, it will be preferable if each third-layer log lies directly above the adjacent first-layer log, such as where vertical walls are to be formed. In such cases, the third-layer logs are optimally positioned (e.g., in the "stack assembly" and in the resulting structure) such that the longitudinal axes of each pair of adjacent first-layer and third-layer logs lie generally in a common plane that is vertical. In other words, the third-layer logs are positioned such that each third-layer log lies generally plumb above an adjacent first-layer log. If desired, though, a structure with sloped walls could be built according to the present invention. Variations of this nature would be obvious to those skilled in the art of building or designing log structures.

In the assembly and method embodiments, the noted first-layer log(s), second-layer log(s), and third-layer log(s) optionally are identified for being assembled together with other logs to produce a predetermined shell. The predetermined shell has a desired total number of layers of logs, and the stack assembly preferably has at least one less layer of logs than this desired total number. For example, such assembly and method embodiments can optionally involve a 3-layer increment being used to build a shell with 4 or more total layers.

It should be noted that more than three layers of logs can be placed in the stacked assembly. Fourth-layer logs could be stacked; fifth-layer logs could be stacked; and additional layers above could be stacked into the assembly, if so desired. A preferred embodiment, however, is to have no more than three layers of logs stacked in the assembly at any given time. Thus, certain embodiments involve the stack assembly having logs from only three layers.

The stack assembly can optionally have a height characterized by a bottom surface of the uppermost layer of logs being no more than about 70 inches off the ground, no more than 60 inches off the ground, or no more than 55 inches off the ground (and/or the top-most surface of the uppermost log of the stack assembly optionally being no more than about 90 inches off the ground, preferably no more than about 80 inches off the ground, and perhaps more preferably no more than about 75 inches off the ground). In some of the assembly and method embodiments, the stack assembly has an uppermost layer of logs that is close enough to the ground to allow a builder to scribe final notch and long grove lines on logs of the uppermost layer while standing on the ground.

A gap is formed between each pair of adjacent first-layer and third-layer logs. The upper and lower boundaries of each gap are formed respectively by the bottom surface of a third-layer log and the top surface of an adjacent first-layer log. The height of each gap will typically vary along the length of the adjacent first-layer and third-layer logs. The number of gaps in a stacked assembly will depend on the layout of the structure. For example, the four-walled structure shown in FIG. 5 has two gaps 31, 33 whereas some eight-walled structures have four gaps (not shown).

It is preferable to adjust the position of each third-layer log so that the height of its gap (relative to the first-layer log below it) is more uniform from end to end. As is discussed below, by making the height of the gap more uniform from end to end, then the wall height that is lost when grooves are cut into the bottom surface of the third-layer log tends to be minimized. Those skilled in the art would be familiar with a number of different ways of accomplishing such a goal.

In a preferred aspect of the invention, positioning apparatuses are used (e.g., adjusted) to make the height of each gap more uniform from end to end. As discussed above, such devices preferably have features that allow a user to adjust the position of each newly stacked log (the logs of the topmost layer in the assembly) vertically, laterally, rotationally, and lengthwise. Thus, it preferably would be possible to adjust the position of each third-layer log (in FIG. 5) such that the height of its gap is more uniform from end to end over the length of the gap. It is not a requirement that the gap be uniform, of course, as there can be circumstances when the skilled artisan might desire a gap that has an overall tapered shape from end to end, or some other shape. In some method embodiments, though, the method includes making a desired third gap more uniform from end to end by adjusting one or more of the positioning apparatuses that hold the third-layer log that is above the third gap in question.

Figure 6:
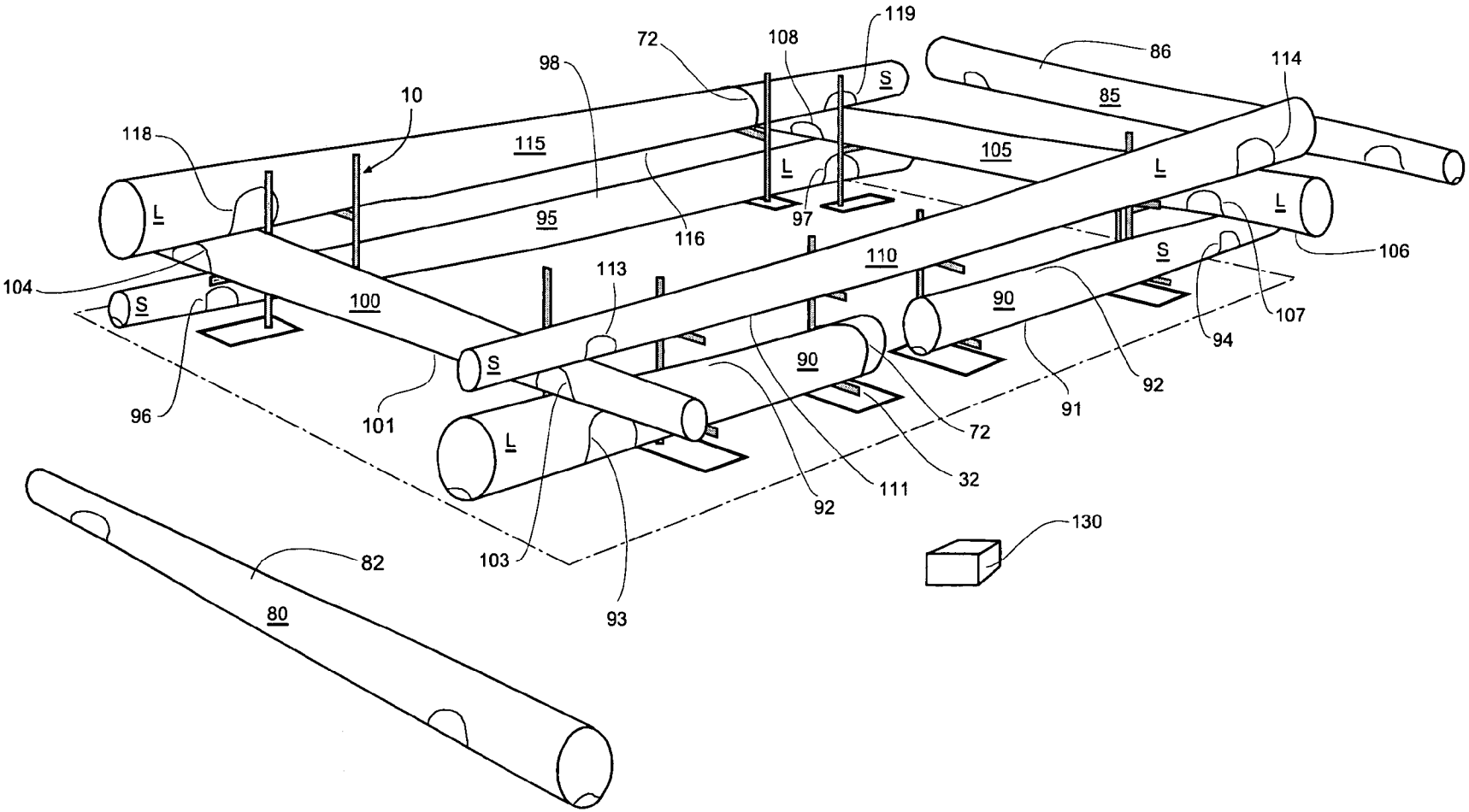
FIG. 6 shows a front inclined view of an assembly of apparatuses and logs in an embodiment of the present invention.
Figure 8:
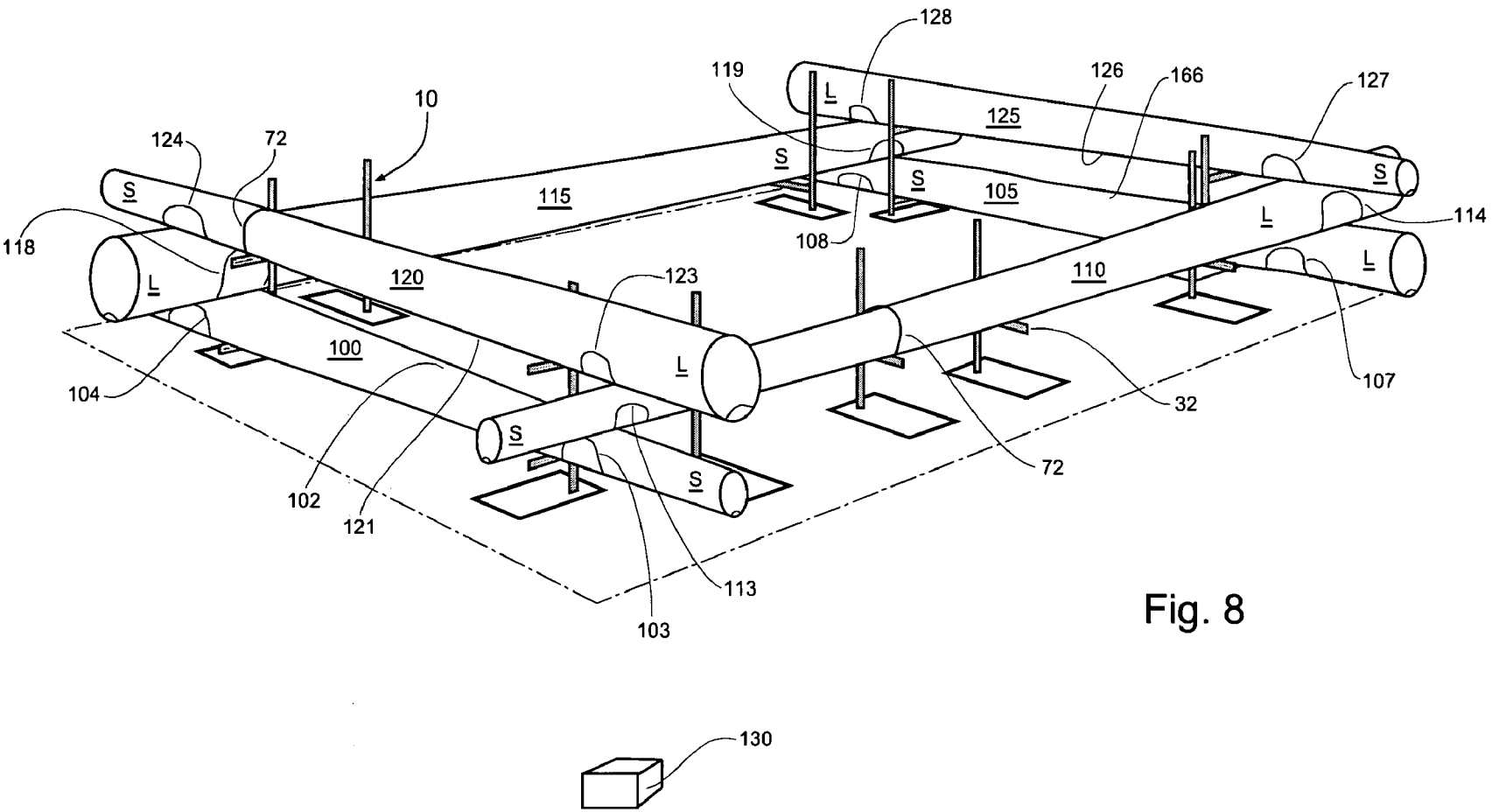
FIG. 8 shows a front inclined view of an assembly of apparatuses and logs in an embodiment of the present invention.

It is well known by those skilled in the relevant art that it can be advantageous to orient logs in the same wall such that vertically adjacent logs have their small and large ends inversely oriented. For example, the pair of adjacent first-layer 80 and third-layer 100 logs and the adjacent pair of logs 85, 105, illustrated in FIG. 5, have their small S and large L ends inversely oriented. Likewise, the pair of adjacent second-layer 90 and fourth-layer 110 logs, and the adjacent pair of second-layer log 95 and fourth-layer log 115, both as shown in FIG. 6, have their small S and large L ends inversely oriented. The same is true of each adjacent pair of third-layer log 100 and fifth-layer log 120, and of pair third-layer log 105 and fifth-layer log 125, as shown in FIG. 8. It can be advantageous to repeat such an inverse oriented pattern for each new log, and layer, that is added to the structure since it tends to produce walls that are level. It would be obvious to those of ordinary skill in the art of log building that other variations of this pattern would also be acceptable.

It is also well known by skilled artisans in the present field that logs in adjoining walls can be oriented to certain advantageous patterns to produce a structure wherein adjoining walls are approximately level. Optimally, the end regions of the logs that form each corner are oriented such that they exhibit a small end, small end, large end, large end pattern (a "SSLL" pattern). An obvious variation on the SSLL pattern would be a pattern that goes SLLSSLL and so on. Likewise, a LSSLLSS pattern would be possible. Since this pattern is well known to those of ordinary skill in the instant art, it will not be discussed in further detail. Furthermore, the present invention can be practiced without orienting the logs in adjoining walls according to any such pattern.

In some assembly and method embodiments, the assembly includes a plurality of motors that can be operated to vertically move support arms of the positioning devices. Optionally, each positioning device can have a motor. In some cases, the assembly includes a controller adapted for simultaneously actuating at least a subset (optionally all) of the motors of the assembly.

Log structures can be built to virtually any practical height. While the stacking, positioning, and scribing of five layers of logs will be described herein, additional layers of logs could be added in accordance with this discussion, and a log building of any height (including less than five layers) can be built with methods of the invention.

After stacking three layers of logs, it is possible to determine the cuts that will ultimately be made in such logs.

In traditional log-by-log building, every log in a layer is fully processed and finally fitted in its permanent position before any of the logs in the layers above are processed. Unfortunately, the time requirements of the traditional methodology are well known to those who build handcrafted log structures. With the present invention, it would be possible to provide a steady stream of marked and scribed logs from the stacked assembly to workers who could then cut out notches and grooves or otherwise prepare the logs for transport to the customer. The benefits of the efficiency of the present method, and in particular its organization of labor and movement of materials (logs) through a series of steps or processes, are great. One benefit could include specialization of labor of the workforce since there is a continuing and repetitive need for worker(s) who load logs into the stacked assembly and scribe them; there is also a continuing and repetitive need for worker (s) to process the logs that have been so marked.

The accelerated log building method, wherein large batches of scribed logs are produced at one time, may require workers to switch tasks at hand—for example, stop scribing when all the logs of a stacked shell have been scribed, and then start cutting notches and grooves, and processing cut logs. The accelerated workflow also, therefore, may require that each worker be skilled in several tasks and machines, not just one or a few tasks and skills.

In the present methods, each craftsman does not have to be skilled in many, or all, the log building processes and techniques. In addition, the present method can provide a steady flow of materials (logs) to be processed through each phase of the production, instead of large numbers of logs (an entire house-lot of logs in many cases) moving from one processing phase to the next processing phase in batches.

In addition, in a preferred embodiment of the present invention, the stacked assembly of three layers of logs remains about the same height as logs are processed through all the steps (in embodiments of this nature, the assembly has no more than three layers of logs at any given time). The overall maximum height of an incrementally stacked assembly need not get incrementally taller over time (as additional layers of logs for a given shell are processed), so the workers can perform ordinary and common tasks without the need of ladders or scaffold. Traditional log-by-log building stacks, by necessity, get tall (often more than 10 feet tall), and therefore require large amounts of scaffolding, ladders, or other equipment to allow men to work relatively safely at heights above the ground. The present invention can advantageously provide enhanced safety for workers (since they can work on or near the ground), and also may require less equipment.

Figure 7:
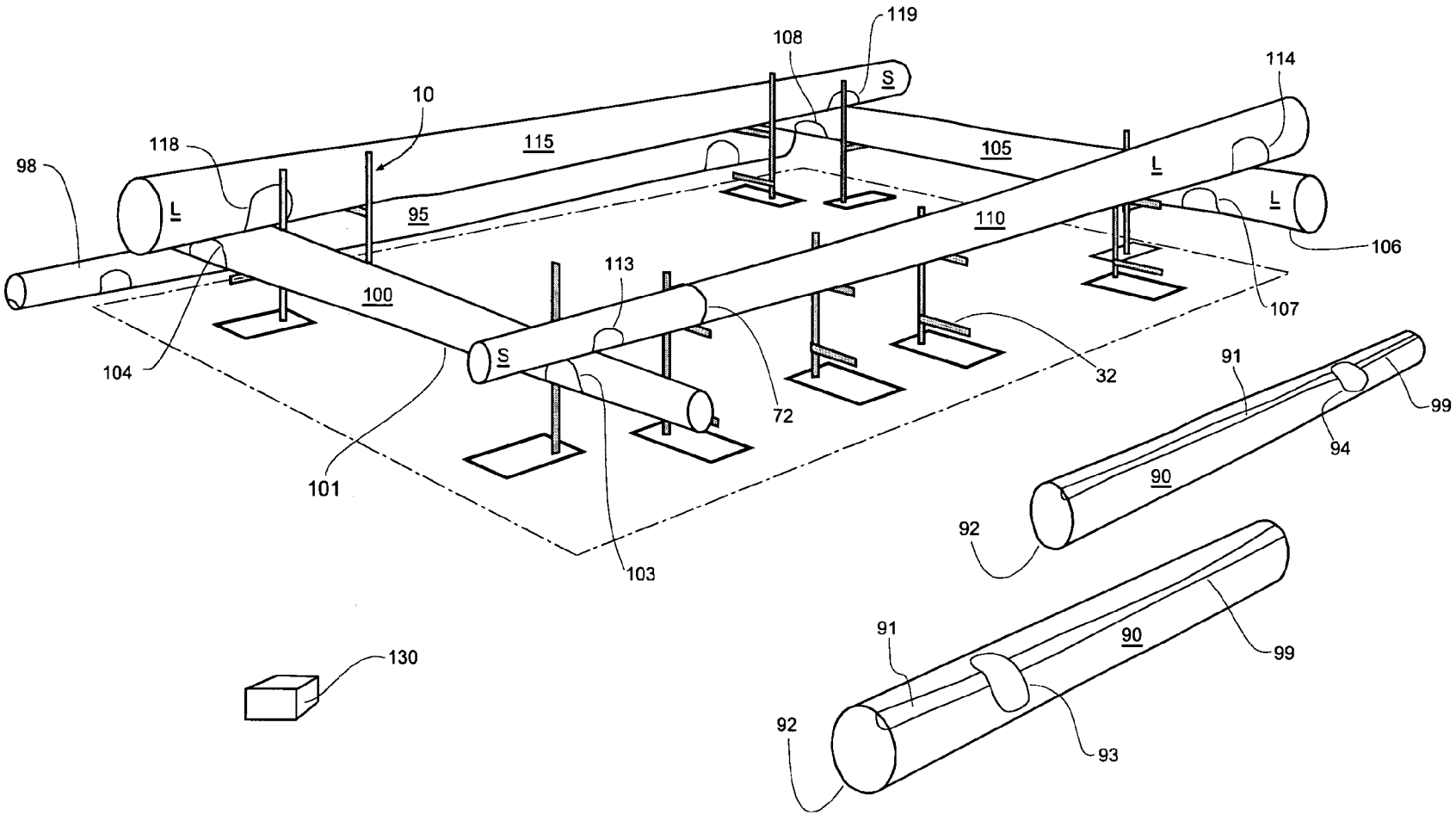
FIG. 7 shows a front inclined view of an assembly of apparatuses and logs in an embodiment of the present invention.

At least two different types of cuts will ultimately be made in most of the wall logs (after the dimensions and locations for such cuts have been determined in accordance with the present invention). A groove (or "long groove") will be cut along the bottom length of many logs, and a final notch will be cut into one or both end region(s) of most logs. Log 90 (which has two parts) as shown in FIG. 7 has been removed from the stacked assembly, and rolled over to illustrate that on its bottom side 91 there have been marked lines outlining the long groove 99 and the final notches 93 and 94.

It will be understood that the discussion herein of long grooves and final notches refers only to those logs that require such cuts. That is, the discussion should not be interpreted to mean that each log in a structure built according to the present invention must have a long groove cut and final notch cuts. As would be obvious to those of ordinary skill in the art of log building, it is not necessary to make such cuts in every log in a structure.

The manner in which the configurations of long groove cuts and final notch cuts are determined will now be discussed in turn. The long groove cuts that will ultimately be made along the bottom length of each log are configured such that the top and bottom surfaces of each pair of adjacent logs will be engaged as completely as possible along their length when each log is fitted into its final position. A groove cut will be made along the bottom length of the uppermost log in each pair of adjacent logs. A groove cut is commonly made along the bottom length of every log in a structure except the sill logs (the bottommost logs of a structure, e.g., the logs that typically rest upon the floor or foundation of the building). It is typically not necessary to cut a groove in the bottom length of the sill logs since the bottom surfaces of these logs will not engage the top surface of other logs.

Each groove cut made along the bottom length of a log may match the contour of the top surface of the adjacent log below. Any suitable method for determining the configuration of a long groove cut could be used in accordance with the present invention. Commonly, a marking instrument (a "scriber") similar to an inside caliper is used to mark lines along the length of the bottom surface of each log that will have a long groove. Log building scribers are well-known in the present art. Ultimately, the wood below (in other words, between) these lines will be removed to form a long groove.

The caliper (or "scriber") typically has an upper arm and a lower arm, each bearing a marking point. Commonly, each scriber arm bears a marking point (such as a pen or pencil) that is used to mark the dimensions of the groove cuts that will eventually be made. In marking (or "scribing") each groove cut with such an instrument, the upper and lower marking points of the scriber are set a certain distance apart. This distance is commonly referred to as the "scribe setting" or "scriber setting." The long groove scriber setting used for a given pair of adjacent logs is at least as great as the maximum height of the gap between those two logs.

By using a long groove scribe setting that is at least as great as the maximum height of the gap, the builder is assured that each pair of adjacent logs will be engaged all the way along their length when the logs are finally fitted into a permanent position. Preferably, the long groove scriber setting is slightly larger than the maximum height of the gap, as this will assure a more substantial engagement between each adjacent pair of logs when fitted into a permanent position. Excellent results have been achieved using a scriber setting that is about one-quarter of one inch greater than the maximum height of each gap. However, this is by no means required.

The tips of the scriber are dragged along the length of the gap between first-layer and third-layer logs, for example, all the while keeping the scriber marking points in a plumb position. This scribing draws a line along the length of the bottom surface of the third-layer log. The scribe lines will commonly be serpentine or wavelike since they match the unique contour (or "topography") of each log. The scriber may be dragged along the surfaces that will form the inside wall surface of the structure, the outside wall surface of the structure, or both. Preferably, the scriber is dragged along both the inside and outside wall surfaces so a line is marked on both sides of each log that is to have a long groove. The wood below (that is, between) each of these lines will ultimately be removed to form a long groove in each log.

A variety of differently shaped long grooves can be cut into the bottom surface of each third-layer log. A simple long groove may comprise a concave channel cut along the bottom length of each log. For example, U.S. Pat. No. 2,525,659, issued to Edson et al. (the teachings of which are herein incorporated by reference), shows a particular use of concave long grooves. Another type of long groove that is commonly referred to as the "double-cut long groove" (U.S. Pat. No. 4,951,435 issued to Beckedorf) comprises two concave channels running side-by-side along the bottom length of each log. Since selecting the appropriate types of long grooves to use in a given structure would be obvious to those having ordinary skill in the art of log building, it will not be discussed in further detail. Builders commonly use a chainsaw to cut each long groove. In some cases, though, a chisel, planer, or sander may be used to perfect the cut(s).

Typically, a final notch cut will eventually be made in both end regions of most logs (e.g., at each "log corner"). The configuration of each final notch cut that will be made should reflect the contour of the top surface of the log over which it will ultimately be fitted. The configuration of each final notch cut is commonly determined using a scriber in much the same way as was discussed above with reference to long grooves. In marking each final notch cut, the upper and lower marking points of the scriber are set to the desired final notch scribe setting. The tips of the scriber are then dragged along the intersection of these two logs (all the while keeping the marking points plumb) to form an outline of the final notch that will be cut into the log. Since this traditional method of scribing final notches would be obvious to those having ordinary skill in the art of log building, it will not be discussed in further detail.

With log 100 manipulated into its desired position (in reference to FIG. 5), and fixed (not shown) to the arm assemblies 32 that are supporting it, then the widest gap between log 80 and log 100 can be determined, and a scriber can be set slightly larger than the amount of this widest gap. The long groove can then be scribed (or otherwise provided with indicia for cutting) on the bottom side region 101 of the third-layer log 100.

Note that the present assembly allows for a safe and comfortable working height for marking final notches and long grooves. An operator, standing with his feet on the floor, and without necessarily requiring a ladder or scaffold, can scribe notches and grooves, and can also make other markings on the logs and make other cuts (such as drilling holes).

Continuing in reference to FIG. 5, the final notch scribe line 103 and final notch scribe line 104 can be scribed on log 100 at this time, or later if desired (as will be described below). At the log corner where log 80, log 90, and log 100 will intersect, the final notch 103 is drawn with a scriber setting that is substantially equal to the long groove scribe setting determined above for the bottom side region 101 minus the final notch scriber setting used for the final notch 93. At the log corner where log 80, log 95, and log 100 will intersect, the final notch scribe line 104 is marked with a scriber setting that is substantially equal to the long groove scribe setting determined for the scribed bottom side region 101 minus the final notch scriber setting used for final notch 96 of second-layer log 95.

With the instant method, the final notch scribe setting 104 and the final notch scribe setting 103 need not necessarily be equal. These final notch scribe settings could be equal in this embodiment, but they are not by any means required to be equal. Moreover, in certain embodiments of the invention, they are not equal (i.e., they are different).

With log 105 in its desired position and fixed (not shown) to the arms 32 that are supporting it to reduce or limit unwanted subsequent movement, then the widest gap between log 85 and log 105 can be determined, and a scriber can be set slightly larger than the amount of the widest gap. The long groove can then be scribed (or otherwise marked with indicia for cutting) on the bottom side region 106 of third-layer log 105.

The long groove scriber settings for log 100 and log 105 (both of these logs being members of the third layer) may be the same, but it is by no means a requirement that they must be the same, in an embodiment of the present invention. Moreover, in certain embodiments, they are different.

Note that the present assembly allows for a safe and comfortable working height for marking final notches and long grooves. An operator, standing with his feet on the floor, and without requiring a ladder or scaffold, can scribe notches and grooves, and make other such markings on the logs, and make other cuts (such as drilling holes) as are desired.

The final notch scribe line 107 and final notch scribe line 108 can be scribed on log 105 at this time, or later if desired. At the log corner where log 85, log 90, and log 105 will intersect, the final notch 107 is marked with a scriber setting that is substantially equal to the long groove scribe setting determined above for the bottom side region 106 minus the final notch scriber setting used for the final notch 94. At the log corner where log 85, log 95, and log 105 will intersect, the final notch 108 is drawn with a scriber setting that is substantially equal to the long groove scribe setting determined for the scribed bottom side region 106 minus the final notch scriber setting used for the final notch 97.

With the instant method, the final notch scribe setting 107 and the final notch scribe setting 108 need not necessarily be equal. These final notches scribe settings could be equal, but they are not by any means required to be equal. In certain embodiments, they are different.

With reference to FIG. 6, there is illustrated the simple 4-wall assembly of FIG. 5, now modified in accordance with certain embodiments of the present invention, namely, first-layer logs 80, 85 have been removed from the bottom of the stacked assembly; the second-layer and third-layer logs have been uniformly lowered vertically so as to maintain the spatial relationship they had to each other in FIG. 5; and a fourth layer of logs has been added to the top of the assembly. That is, the assembly has been incrementally changed: the bottom layer removed, the middle and upper layers lowered (as if they were a single entity); and a new layer added on top. Log 90 and log 95 form a second layer; log 100 and log 105 form a third layer; and log 110 and log 115 form a fourth layer.

In the above-mentioned first group of method embodiments, after removing the noted first-layer log from the stack assembly, the method preferably comprises adjusting the stack assembly by moving the noted second-layer log and the noted third-layer log to respective lower elevations (preferably, this involves moving the noted second-layer log and the noted third-layer log downwardly by the same amount, i.e., by the same increment). Preferably, this involves adjusting the stack assembly by adjusting a plurality of log-positioning devices. Such log-positioning devices can advantageously be adjusted so as to cause vertical motion of support arms of the positioning apparatuses. The positioning apparatuses adjusted here preferably have support arms that supportably receive respective bottom side regions of the logs. As noted above, the log-positioning apparatuses in some cases each have an adjustment shaft with a long axis. In such cases, the positioning apparatuses can be adjusted by rotating each adjustment shaft about its long axis in response to which the desired vertical motion of support arms occurs. Optionally, this vertical motion is downward vertical motion and/or this vertical motion involves at least some (optionally all) of the support arms being moved simultaneously by a common increment. One or motors can optionally be used to initiate the vertical motion of support arms, if so desired.

As illustrated in FIG. 6, first-layer log 80 and first-layer log 85 have been removed from their positions near the bottom of the assembly stack. One preferred embodiment, and in reference to FIG. 5, involves uniformly lowering all the logs held by all the apparatuses in unison (and in the same direction, and the same distance), optionally using a master control device (e.g., a controller) 130. For example, the first-layer logs 80, 85 can be lowered onto wheeled dollies (not shown) on the floor, and then the arms of all apparatuses 10 could be lowered in unison and by a sufficient amount to allow log 80 and log 85 to be supported by the dollies. The optional fixing chain (not shown) would be released from the first-layer logs, and the first-layer log could then preferably be pushed away from the stacked assembly, and across the floor. The arms 32 that had been supporting log 80 and log 85 could then be removed from apparatuses 10 (an exemplary procedure whereby support arms may be removed having been described above).

Following this, and optionally using a control device 130, log 90, log 95, log 100, and log 105 would be lowered in unison (and in the same direction, and the same distance) to a convenient height, optionally so that the bottom side regions of logs 90, 95 are about eight inches above the floor, though any number of other heights could be used, and no particular height is required.

In certain method embodiments, the method includes operating a control device (or "controller") to simultaneously actuate at least a subset of motors of the assembly. In one embodiment, the control device 130 has an electronic switch that activates motors 70 to cause shafts 22 to rotate, thus causing simultaneous vertical movement of all arms 32, in unison (and in the same direction, and by the same distance). It would be preferred for the control device 130 to allow an operator be able to specify either an "up" vertical motion, or a "down" vertical motion. The control device could, in some embodiments, additionally allow the operator to specify the vertical distance to be offset in each such movement activated by the control device. Alternatively, the operator could specify a certain number of revolutions of the shaft 22. In one preferred embodiment, actuating the control device results in every support arm in the assembly moving in the same direction, by the same amount, at the same time. Simultaneously controlled motion of arms is not required, however, and arms 32 could be moveable individually without departing from the spirit of the invention.

Thus, in certain assembly and method embodiments, the log-positioning apparatuses have support arms adapted for being simultaneously moved vertically by a common increment in response to one or more motors. In some embodiments of this nature, the assembly comprises a plurality of motors and each log-positioning apparatus has a motor. In related method embodiments, a plurality of motors are actuated so as to cause vertical motion of support arms of respective log-positioning apparatuses. One or more (optionally all) of the motors, for example, can be stepper motors.

In the noted first group of method embodiments, the method can optionally include adding a first-overlying-layer log to a top of the stack assembly. Here, the first-overlying-layer log preferably is added such that at least one of its end regions is above a subjacent log that is part of the stack assembly. In some embodiments of this nature, the first-overlying-layer log is added to the stack assembly after the above-noted removal of the first-layer log from the stack assembly. The first-overlying-layer log can be a fourth-layer log and the subjacent log can be a third-layer log. This, however, is not required. For example, the "first-overlying-layer log" can alternatively be a fifth-layer log, a sixth-layer log, etc. However, in cases where the first-overlying-layer log is a fourth-layer log, this log preferably is added to the top of the stack assembly so as to be above and extend alongside a second-layer log. In these cases, the method preferably further includes determining final corner notch indicia for the noted third-layer log, determining long groove indicia for the noted fourth-layer log, and thereafter removing the noted second-layer log from the stack assembly. Optionally, a fifth-layer log is added to the stack assembly such that at least one of its end regions is disposed above a fourth-layer log. When performed, this addition of a fifth-layer log can optionally be done after the noted removal of the second-layer log(s).

An arm 32 can be placed on each apparatus 10 needed to support the end regions of the fourth-layer logs. (An exemplary method of installing an arm has been described above, and will not be repeated here.) As is illustrated in FIG. 6, fourth-layer logs (log 115 and log 110) can be put onto support arms 32. In a preferred embodiment it would be common to use the support arms 32 that have been recently removed from the bottom of the apparatuses 10, and that had been recently supporting first-layer logs 80, 85. Thus, it is advantageous to provide support arms that can be quickly removed, and then re-attached elsewhere, as desired.

FIG. 6 shows two fourth-layer logs 110, 115 positioned above two third-layer logs 100, 105 in a crosswise stack wherein each end region of each fourth-layer log is positioned above one end region of a third-layer log. Each end region of each fourth-layer log need not be contiguous with (that is, touching) the third-layer log below. For example, it may be desirable to raise (or lower) one end or both ends of certain fourth-layer logs. Moreover, the fourth-layer logs are preferably not directly supported by third-layer logs, though in alternative embodiments such logs could be touching.

The fourth-layer logs held, by such devices, preferably can be moved vertically and horizontally to allow the position of each fourth-layer log to be independently adjusted laterally, vertically, and lengthwise. Likewise, the fourth-layer logs held by such devices preferably can be rotated about the longitudinal axis of each log to orient each log as desired. The unique contour of naturally-shaped logs commonly makes it desirable to orient bowed logs in certain ways.

It is preferable that the end regions of the fourth-layer logs not be positioned above, or on, the very end of a third-layer log. In some cases, such positioning will not provide sufficiently stable seating for the fourth-layer logs. Moreover, in many cases the client or builder may desire the distinctive appearance that is achieved by structures that have such log extensions (or "flyways"). However, as would be obvious to those of skill in the art of log building, log extensions would not be required where certain types of notches are used.

In one aspect of the present invention, the fourth-layer logs are arranged in a configuration wherein at least one pair of fourth-layer logs are spaced apart in a generally-opposed configuration with their small and large ends inversely oriented. Commonly, this would be desirable where a pair of spaced-apart fourth-layer logs will form walls on opposite sides of a structure. FIG. 6 illustrates a configuration wherein two generally-opposed fourth-layer logs 110, 115 will form walls on opposite sides of a structure. This orientation of fourth-layer logs reflects a common positioning pattern wherein the parallel logs in the same layer have their small and large ends facing opposite directions. As was discussed, many builders position the parallel logs in the same layer such that their small and large ends face the same direction. Variations of this nature would be obvious to those skilled in the art of log building. Furthermore, skilled artisans in the instant field would recognize that the present invention can be practiced without orienting the small and large ends of the logs in any particular manner. However, as would be obvious to those skilled in the art of log building, such orientations can be used advantageously to construct walls.

Logs can be placed in one piece, spanning from corner to corner, or in two (or more) pieces within one layer of logs. Such log pieces can be advantageously used where there will be openings in the log wall, e.g. doors and windows. More than two log pieces can be used within any layer of logs, as would be obvious to those who are skilled in the art. Using logs in parts is not, however, by any means required, and an entire building can be built of full length logs; or can be built of a combination of full-length and partial-length logs. Furthermore, each wall of a structure may be comprised of either full-length logs, logs in piece, or a combination of both. In FIG. 6, it can be seen that while second-layer log 90 is in two parts, fourth-layer log 110 above it is in one piece. Numerous such variations are possible and will not be discussed further here as they would be obvious to those skilled in the art.

Figure 10:
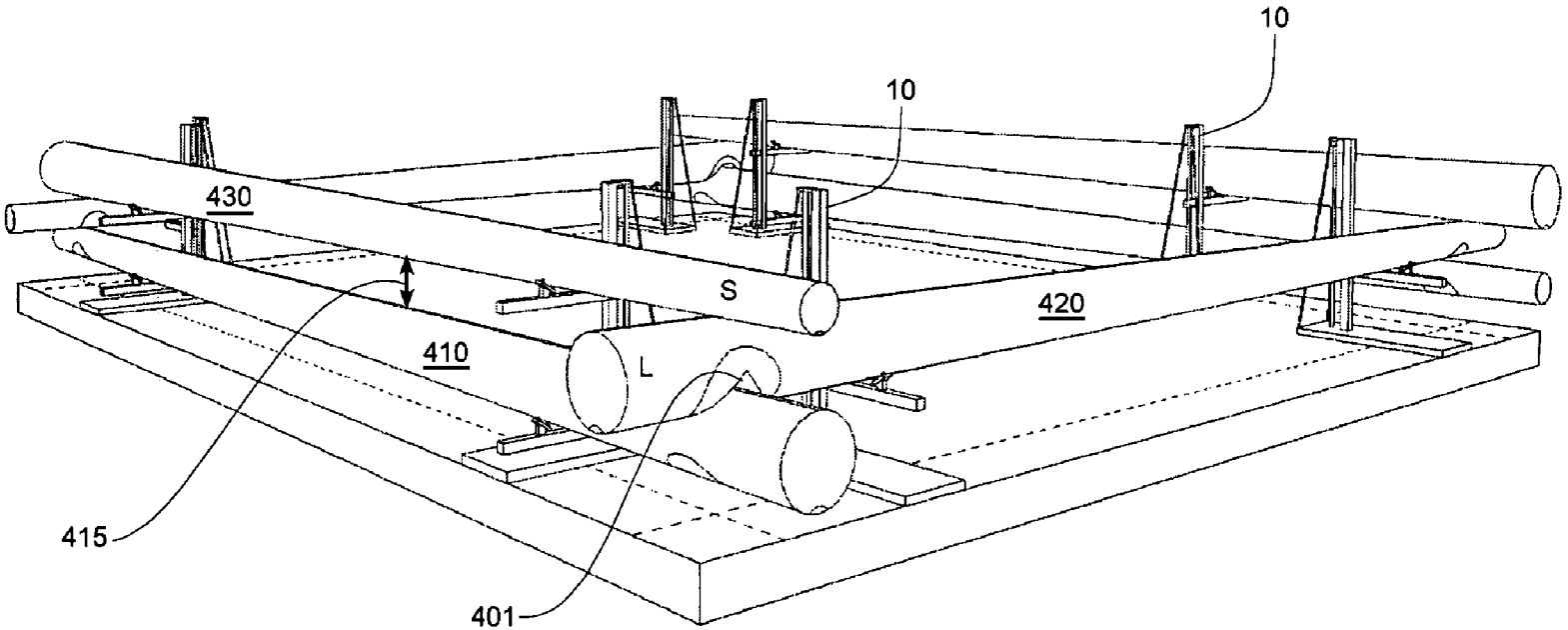
FIG. 10 shows a front inclined view of an assembly of apparatuses and logs in an embodiment of the present invention.

Rough notches can be used at various stages during the building process to accomplish a variety of goals. These goals typically include: making the gap between adjacent pairs of logs more uniform; separating vertically adjacent pairs of logs by a gap of a certain vertical dimension; reducing scriber settings by bringing two adjacent logs closer together and so reducing the height of the gap between them; and providing for making certain logs, or portions of logs, horizontal or level. Since these possibilities are well known to those skilled in the relevant art, they will not be discussed in further detail. Furthermore, the present invention can be practiced without using any rough notches. However, rough notches can be used advantageously in many ways when building structures according to the present invention. In FIG. 10, for example, each rough notched log end region has a generally V-shaped rough notch cut, and a final notch line delineates a larger area of wood to be removed for a final notch to be cut (here, the final notch line surrounds the rough notch). This can optionally be the case for each rough notched log end region.

In most cases, it will be preferable if each fourth-layer log lies directly above an adjacent second-layer log, such as where vertical walls are to be formed. In such cases, the fourth-layer logs are preferably positioned such that the longitudinal axes of each pair of adjacent second-layer and fourth-layer logs lie generally in a common plane that is vertical. In other words, the fourth-layer logs are positioned such that each fourth-layer log lies generally plumb above an adjacent second-layer log. If desired, though, a structure with sloped walls could be built according to the present invention. Variations of this nature would be obvious to those skilled in the art of building or designing log structures.

Builders commonly orient logs that are curved or bowed (or have "sweep") in certain ways. In addition, it is common practice to adjust the position of each log so that its bottom side region is approximately parallel to the top side region of the parallel log below. It should be noted that other log-positioning goals are also typical in the log building art.

It may be advantageous to raise one or both ends of certain fourth-layer logs. In such cases, and as described above, this may involve adjusting one or more height adjustment rods, or the like. Furthermore, a lateral adjustment rod or the like can be used to position the log laterally. As was discussed above concerning logs of the second and third layers, the operator may also position logs rotationally and longitudinally. Such preferred features of apparatus 10 allow the operator to vertically, laterally, lengthwise, and rotationally adjust the position of a log that has been added to the stacked assembly. When logs 110 and 115 have been manipulated into their desired positions, it would be advantageous to fix each log to its support arms as described above so as to prevent or limit undesired movement.

More, or fewer, than two apparatuses per log could be used in an assembly. For example, a long log, that might sag under its own weight if supported only by the arms of two different apparatuses (in which each apparatus is near a distal end of such log), could be additionally supported by a third apparatus positioned at a convenient location closer to mid-span of the length of the given log. For example, three, or more, apparatuses can be used to support one log, if so desired. In reference to FIG. 6, log 110 is supported by four apparatuses, though this is by no means a requirement, and two, or three, or some other number of apparatuses could be used. It is a common practice to use some log pieces in the portions and layers of a log wall adjacent to door and window openings in a wall. It is also a preferred practice to span over the top of such wall openings with a full-length, one piece "header" log beam, though this is not a requirement.

In an alternative embodiment, an apparatus can be removed from the assembly, if it is no longer required or desired. In reference to FIG. 7, log 110 is shown as supported by 4 apparatuses—one near each end region of log 110, and two apparatuses in positions intermediate to its end regions. One of the intermediate apparatuses can be removed, or both intermediate apparatuses could be removed, with the additional requirement that log 110 preferably continues to be adequately supported by the remaining apparatus(es) near its end region(s).

With log 110 in its desired position and fixed (e.g., by a fastener 72) to the arms 32 supporting it, then the widest gap between log 90 and log 110 can be determined, and a scriber can be set to an amount that is slightly larger than the height of the widest gap. The long groove can then be scribed (marked with indicia for cutting) onto the bottom side region 111 of log 110.

Note that the assembly allows for a safe and comfortable working height for marking final notches and long grooves. An operator, standing with his feet on the floor, and without requiring a ladder or scaffold, can scribe notches and grooves, and make other markings on the logs, and make other cuts (such as drilling holes).

The scriber setting for the long groove of fourth-layer log 115 does not need to be (and in certain embodiments, is not) the same scriber setting that is used for scribing the long groove of fourth-layer log 110. The long groove scriber settings for log 115 and log 110 (both logs being members of the fourth layer) may be the same, but it is by no means a requirement that they must be the same, in an embodiment of the instant invention.

If final notches 103, or 107 were not scribed earlier (as noted above), then it is preferred to scribe them at this time. In continuing reference to FIG. 6, the final notch scribe line 113 and final notch scribe line 114 can be scribed at this time, or later if desired, on log 110. At the log corner where log 90, log 100, and log 110 will intersect, the final notch 113 is drawn using a scriber setting that is substantially equal to the long groove scribe setting determined above for the bottom side region 111 minus the final notch scriber setting used for the final notch 103 of third-layer log 100. At the log corner where logs 90, 105, and 110 will intersect, the final notch 114 is marked using a scriber setting that is substantially equal to the long groove scribe setting determined for the scribed bottom side region 111 of log 110 minus the final notch scriber setting used to scribe the final notch 107 of third-layer log 105.

With the fourth-layer log 115 in its desired position and fixed (e.g., by a fastener 72) to the arms 32 supporting it, then the widest gap between log 95 and log 115 is determined, and a scriber is set slightly larger than the amount of this gap. The long groove can then be scribed on the bottom side region 116 of fourth-layer log 115.

Note that the assembly allows for a safe and comfortable working height for marking final notches and long grooves. An operator, standing with his feet on the floor, can scribe notches and grooves, and make other markings and make other cuts (such as drilling holes) on the logs of the fourth-layer. If final notches 104 or 108 were not scribed earlier (as noted above), then it is preferred to scribe them at this time.

The final notch scribe line 118 can be scribed at this time, or later if desired, on log 115. At the corner where log 95, log 100 and log 115 will intersect, the final notch 118 is drawn using a scriber setting that is substantially equal to the long groove scriber setting determined above for the bottom side region 116 of log 115 minus the final notch scriber setting used to scribe the final notch 104. At the corner where log 95, log 105, and log 115 will intersect, the final notch 119 is drawn with a scriber setting that is substantially equal to the long groove scriber setting determined for the scribed bottom side region 116 of log 115 minus the final notch scriber setting used to scribe the final notch 108 of third-layer log 105.

Concerning a preferred embodiment, the final notch scribe setting 118 and the final notch scribe setting 119 need not necessarily be equal. The final notch scribe settings could be equal in the present method, but they are not by any means required to be equal. Thus, in some embodiments, they are different.

As illustrated in FIG. 7, second-layer log 90 (in two parts) and second-layer log 95 can be removed from near the bottom of the assembly stack. In one preferred embodiment, all the logs held by all the apparatuses are uniformly lowered in unison (and in the same direction, and the same distance) using a control device 130. For example, the second-layer logs 90, 95 can be lowered onto wheeled dollies (not shown) on the floor, and in the process the arms of all apparatuses 10 could be lowered in unison and by a sufficient amount to allow log 90 and log 95 to be supported by the dollies. A fixing chain or another fastener would be released from the second-layer log(s). The second-layer log(s) could then be pushed away from the stacked assembly, and across the floor, resting on the wheeled dollies. The arms 32 that had been supporting log 90 and log 95 could be removed from apparatus 10 (an exemplary procedure whereby support arms may be removed having been described above).

(As further shown in FIG. 7, second-layer log 90 (in two parts) has been rolled over so as to illustrate long groove scribe lines 99, and final notch scribe lines 93, 94, on bottom side region 91.)

Using control device 130, all third-layer and fourth-layer logs (e.g., log 100, log 105, log 110, and log 115) would be lowered in unison (and in the same direction, and the same distance) to a convenient height preferably so that the bottom side regions of third-layer logs 100, 105 are several inches above the floor, though this exemplary distance range is by no means required.

The lowering of arms 32 is not required to be simultaneous, and each log could be lowered individually, though it would be preferred for all logs remaining in the stack to be moved vertically and in the same direction and by the same amount before they are processed any further.

An additional arm 32 can be placed on each apparatus 10 needed to support the fifth-layer logs near their respective end regions. (An exemplary method of installing an arm has been described above, and will not be repeated here.) As is illustrated in FIG. 8, fifth-layer logs (log 120 and log 125) can be placed onto support arms 32. In a preferred embodiment it would be common to use the support arms 32 that have been recently removed from the bottom of the apparatuses 10, and that had been recently supporting second-layer logs 90, 95, as noted above. Thus, it is advantageous to provide support arms that can be quickly removed, and then re-attached elsewhere, as desired.

FIG. 8 shows two fifth-layer logs 120, 125 positioned above two fourth-layer logs 110, 115 in a crosswise stack wherein each end region of each fifth-layer log is positioned above one end region of a fourth-layer log. Each end region of each fifth-layer log need not be contiguous with (that is, touching) the fourth-layer log below. For example, it may be desirable to raise (or lower) one or both end regions of certain fifth-layer logs. Moreover, the fifth-layer logs are preferably not directly supported by fourth-layer logs, though in alternative embodiments such logs could be touching.

With reference to FIG. 8, log 100 and log 105 form a third layer; log 110 and log 115 form a fourth layer; and log 120 and log 125 form a fifth layer. As described above, the incremental transition is to remove the lowest layer of logs after they are no longer required for scribing the layers above them in the stack; then lowering the remaining layers (here that is the third and fourth layers of logs) as an integrated unit; and then adding one new layer (here that is the fifth layer) at the top of the stacked assembly. Thus, at any given time, the stack assembly preferably has logs from no more than three layers. This, however, is by no means strictly required. Increments of four, or more, layers may be used in other embodiments.

The fifth-layer logs are held in position by devices which preferably allow each fifth-layer log to be adjusted vertically, lengthwise, and laterally. Likewise, the logs of the fifth layer may be positioned rotationally as described above with respect to the logs of other layers.

It is preferable that the end regions of the fifth-layer logs not be positioned above, or on, the very end of a fourth-layer log. In some cases, such positioning will not provide sufficiently stable seating for the fifth-layer logs. Moreover, in many cases the client or builder may desire the distinctive appearance that is achieved by structures that have such log extensions (or "flyways"). However, as would be obvious to those of skill in the art of log building, log extensions would not be required where certain types of notches (such as dovetail) are used.

In one aspect of the present invention, the fifth-layer logs are arranged in a configuration wherein at least one pair of fifth-layer logs are spaced apart in a generally-opposed configuration with their small and large ends inversely oriented. Commonly, this would be desirable where a pair of spaced-apart fifth-layer logs will form walls on opposite sides of a structure. For example, FIG. 8 illustrates a configuration wherein a pair of generally-opposed fifth-layer logs 120, 125 continue to incrementally form walls on opposite sides of a structure.

This orientation of fifth-layer logs reflects a common positioning pattern wherein the parallel logs in the same layer have their small and large ends facing opposite directions. As discussed above, many builders position the parallel logs in the same layer such that their small and large ends face the same direction. As would be obvious to those skilled in the art of log building, such orientations (and variations described above) can be used advantageously to construct walls.

Logs can be placed in one piece, spanning from corner to corner, or in two pieces within one layer of logs. More than two log pieces can be used within any layer of logs. Using logs in parts is not, however, by any means required, and an entire building can be built of full length logs; or of a combination of full-length and partial-length logs.

Rough notches can be used at various stages during the building process to accomplish a variety of goals. These goals typically include: making the gap between adjacent pairs of logs more uniform; separating vertically adjacent pairs of logs by a gap of a certain vertical dimension; reducing scriber settings by bringing two adjacent logs closer together and so reducing the height of the gap between them; and providing for making certain logs or portions of logs horizontal or level. Since these possibilities are well known to those skilled in the relevant art, they will not be discussed in further detail. Furthermore, the present invention can be practiced without using any rough notches. However, rough notches can be used advantageously in many ways when building structures according to the present invention. FIG. 10 depicts an exemplary embodiment wherein a stack assembly includes a plurality of positioning devices holding a plurality of logs in an elevated (i.e., above ground) cross-wise stack in which at least one log (or each of a plurality of logs) has therein formed a rough notch cut. When provided, a plurality of such rough notched logs can be held (i.e., supported) above ground by a plurality of positioning devices.

In most cases, it will be preferable if each fifth-layer log lies directly above an adjacent third-layer log, such as where vertical walls are to be formed. In such cases, the fifth-layer logs are preferably positioned such that the longitudinal axes of each pair of adjacent third-layer and fifth-layer logs lie generally in a common plane that is vertical. In other words, the fifth-layer logs are positioned such that each fifth-layer log lies generally plumb above an adjacent third-layer log. Variations (including sloped walls) would be obvious to those skilled in the art of building or designing log structures.

In addition, it will commonly be desirable to adjust the position of a fifth-layer log so that its bottom side region is approximately parallel to the top region of a third-layer log below it. Further, it will be commonly desirable to adjust the position of a fifth-layer log 125 so that its bottom side region 126 is approximately parallel (and/or as parallel as desired) to a top region 166 of a third-layer log 105.

It may be advantageous to raise one or both ends of certain fifth-layer logs. In such cases, this may involve adjusting one or more height-adjustment rods, or the like. Furthermore, a lateral-adjustment rod or the like can be used to position a desired log laterally. As has been described above for logs of other layers, a log may also be positioned longitudinally and rotationally. Such preferred features allow the operator to adjust the position of each log as it is added to the top of the stacked assembly: vertically, laterally, longitudinally, and/or rotationally, or any combination so desired. Once logs 120 and 125 have been manipulated into their desired positions (as described above), it would be preferred to fix each log to its support arms as described above so as to prevent or limit the undesired movement of a fifth-layer log.

With log 120 now in its desired position and fixed (e.g., by a fastener 72) to the arms 32 supporting it, then the widest gap between log 100 and log 120 is determined, and a scriber is set slightly larger than the amount of this gap. The long groove of log 120 can then be scribed onto the bottom side region 121.

Note that the assembly allows for a safe and comfortable working height for marking final notches and long grooves. An operator, standing with his feet on the floor, and without requiring a ladder or scaffold, can scribe notches and grooves, and make other markings on the logs, and make other cuts (such as drilling holes).

The scriber setting for the long groove of log 120 does not need to be (and in some embodiments, is not) the same scriber setting that is used for scribing the long groove of log 125. The long groove scriber settings for log 120 and log 125 (both logs being members of the fifth-layer) may be the same, but it is by no means a requirement that they are the same.

If final notches 113 or 118 were not scribed earlier (as noted above), then it is preferred to scribe them at this time. Continuing in reference to FIG. 8, the final notch scribe line 124 and final notch scribe line 123, both on log 120, can be scribed at this time, or later if desired. At the corner where log 100, log 110, and log 120 will intersect, the final notch 123 is marked using a scriber setting that is substantially equal to the long groove scriber setting determined above for the bottom side region 121 minus the final notch scriber setting used for the final notch 113 of fourth-layer log 110. At the corner where log 100, log 115, and log 120 intersect, the final notch 124 is drawn with a scriber setting that is substantially equal to the long groove scriber setting determined for the scribed bottom side region 121 of log 120 minus the final notch scriber setting used for the final notch 118 of fourth-layer log 115.

With fifth-layer log 125 in its desired position and fixed (not shown) to the arms 32 supporting it, then the widest gap between third-layer log 105 and fifth-layer log 125 is determined, and a scriber is set slightly larger than the amount of this gap. The long groove is then scribed on the bottom side region 126 of log 125. The long groove scribe setting used for log 125 and the long groove scriber setting used for log 120, both being members of the fifth-layer, need not necessarily be equal. The long groove scriber settings for log 120 and log 125 (both logs being members of the fifth layer) may be the same, but it is by no means a requirement that they must be the same. Moreover, in some embodiments, they are not the same (i.e., they are different).

Note that the instant stacked assembly allows for a safe and comfortable working height for marking final notches and long grooves. An operator, standing with his feet on the floor, can scribe notches and grooves, and make other markings and make other cuts (such as drilling holes) on the fifth-layer logs. It should be noted that it is not normally possible in traditional log-by-log construction for a builder to be able to scribe fifth-layer logs while standing with his feet on the ground. With traditional log building methods, ladders, scaffolding, or other lifting devices are typically required for the fifth layer and higher.

If final notches 114 or 119 were not scribed earlier (as noted above), then it is preferred to scribe them at this time. The final notch scribe line 127 and final notch scribe line 128 can be scribed on fifth-layer log 125 at this time, or later if desired. At the corner where log 105, log 110 and log 125 intersect, the final notch 127 uses a scriber setting that is substantially equal to the long groove scriber setting determined above for the bottom side region 126 of fifth-layer log 125 minus the final notch scriber setting used for the final notch 114 of fourth-layer log 110. At the corner where log 105, log 115, and log 125 intersect, the final notch 128 is marked using a scriber setting that is substantially equal to the long groove scriber setting determined for the scribed bottom side region 126 of fifth-layer log 125 minus the final notch scriber setting used for the final notch 119 of fourth-layer log 115.

In a preferred embodiment of the present invention, the final notch scribe setting 127 and the final notch scribe setting 128, both of fifth-layer log 125, need not necessarily be equal. These final notch scribe settings could be equal in the present method, but they are not by any means required to be equal.

In embodiments of the present invention, scriber lines can optionally be marked on the logs in determining desired cuts for final notches and long grooves. However, other types of indicia can alternatively or additionally be used, such as shading, painting, chalking, or the like. Moreover, the indicia can be determined and stored remotely (i.e., not on the log), such as by a computer having a topographical model of the log where the model shows the areas of wood to be removed from the log. Many other types of indicia (taping the log to provide indicia, roughing the log to provide indicia, etc.) can be used as well.

Exemplary methods of incrementally cycling layers of logs through a stacked assembly have been described above. The cycle can be repeated as many times as required for the project at hand. In summary, the incremental cycle may preferably include some, or all, of the following steps: removing the lowest layer of logs from the stack (after they are no longer required for scribing logs in the layers above them in the stack); lowering, as an integrated group, the layers of logs that are still in the stack (that is, treating the top two layers as if they were a single entity being moved vertically to a lower elevation using the apparatuses, and not changing the position of the logs in such layers relative to each other); adding one new layer of logs to the top of the stacked assembly (and independently adjusting each new log into a preferred and desired position, and without moving any log in the layers below); and then scribing the long grooves and final notches of the logs in the layer that is currently topmost.

In some embodiments involving an incremental cycling method, the method involves a log-layer-removal repetition technique comprising a plurality of cycles. Each cycle, for example, can include removing a lowermost layer of logs from the bottom of the stack assembly, whereafter logs remaining on the stack assembly are moved vertically (optionally downwardly). Each cycle may also include adding an uppermost layer of logs to a top of the stack assembly and scribing logs of at least one layer of the stack assembly. Some particular embodiments involve a log-layer-removal technique that is a log-layer-addition/scribing/log-layer-removal/lowering technique. In these embodiments, each cycle preferably includes: (1) adding an uppermost layer of logs to the stack assembly; (2) scribing logs of at least one layer of the stack assembly; (3) the noted removal of the lowermost layer of logs from the stack assembly, and; (4) the noted movement of remaining logs vertically (optionally downwardly). Here, the repetition technique will commonly involve at least four cycles, although this is not required. Preferably, the cycles are continued until all logs of the desired total number have been scribed.

In this way, all the logs of a building of virtually any wall height can be processed without requiring that the stacked incremental assembly be taller than three layers. For example, in such a method embodiment, a log structure that has twenty four layers of logs in its walls can be processed by worker(s) who keep their feet on the ground, because it is not required that any incremental instance of the stacked assembly be more than three layers tall.

In accelerated log building, the long groove scribe setting typically is the same within a given layer of logs. (For example, all the logs of the fourteenth-layer, on all walls of the structure, are typically scribed using the same long groove scriber setting.) In the present method, however, there is no requirement that the long groove scriber settings of a given layer of logs be the same. In fact, in certain embodiments, logs within a given layer are each scribed with a different long groove scribe setting.

The scribe setting for the final notch of a given end region of a given log is determined in a given corner of the stacked shell, and is equal to the long groove scriber setting of the given log minus the final notch scribe setting that was used for the cross-wise log that is in the given corner and that additionally is in the layer immediately below the given log. This relationship, in certain embodiments, is used for determining the scribe setting for each final notch. Thus, there is no requirement that the scribe settings must be the same for the final notches of a given log. This is in contrast to both accelerated log building and traditional log-by-log methods.

Above, there has been a detailed description of exemplary embodiments (e.g., method and assembly) as applied to five layers of an exemplary log structure. If additional layers will be added to a structure (as will often be the case), then a maximum gap determination and a long groove scribe is made (in the same manner as is discussed above) for each additional log of each layer. For example, considering again the simple four-walled structure illustrated in FIGS. 5, 6, 7, and 8, when two sixth-layer logs are added to the top of the stacked assembly, then each of these logs would be independently manipulated into its desired position and orientation, and then each such log would be fixed (e.g., using one or more fasteners) to prevent future undesired movement. The various gaps formed between each adjacent pair of fourth-layer and sixth-layer logs would have a maximum height that would be determined; and a long groove would be scribed on each sixth-layer log (in the same manner as was discussed above with reference to the third, fourth and fifth layers).

The builder would then determine a scribe setting for each of the various final notches of each sixth-layer log, and in a given corner, such final notch scribe setting would be equal to the long groove scribe setting for a given sixth-layer log minus the final notch scribe setting used for the end region of the fifth-layer log that is immediately below the given log, and is also in the given corner of the structure. This can be illustrated by the equation: $N_5=G_4-N_4$; where $N_5$ is the scriber setting for the final notch of a given end region of a given sixth-layer log; where $G_4$ is the scriber setting used to the draw the long groove of the given sixth-layer log; and where $N_4$ is the scriber setting used to mark the final notch that is on the end region of the fifth-layer log that is in the given corner.

Figure 9:
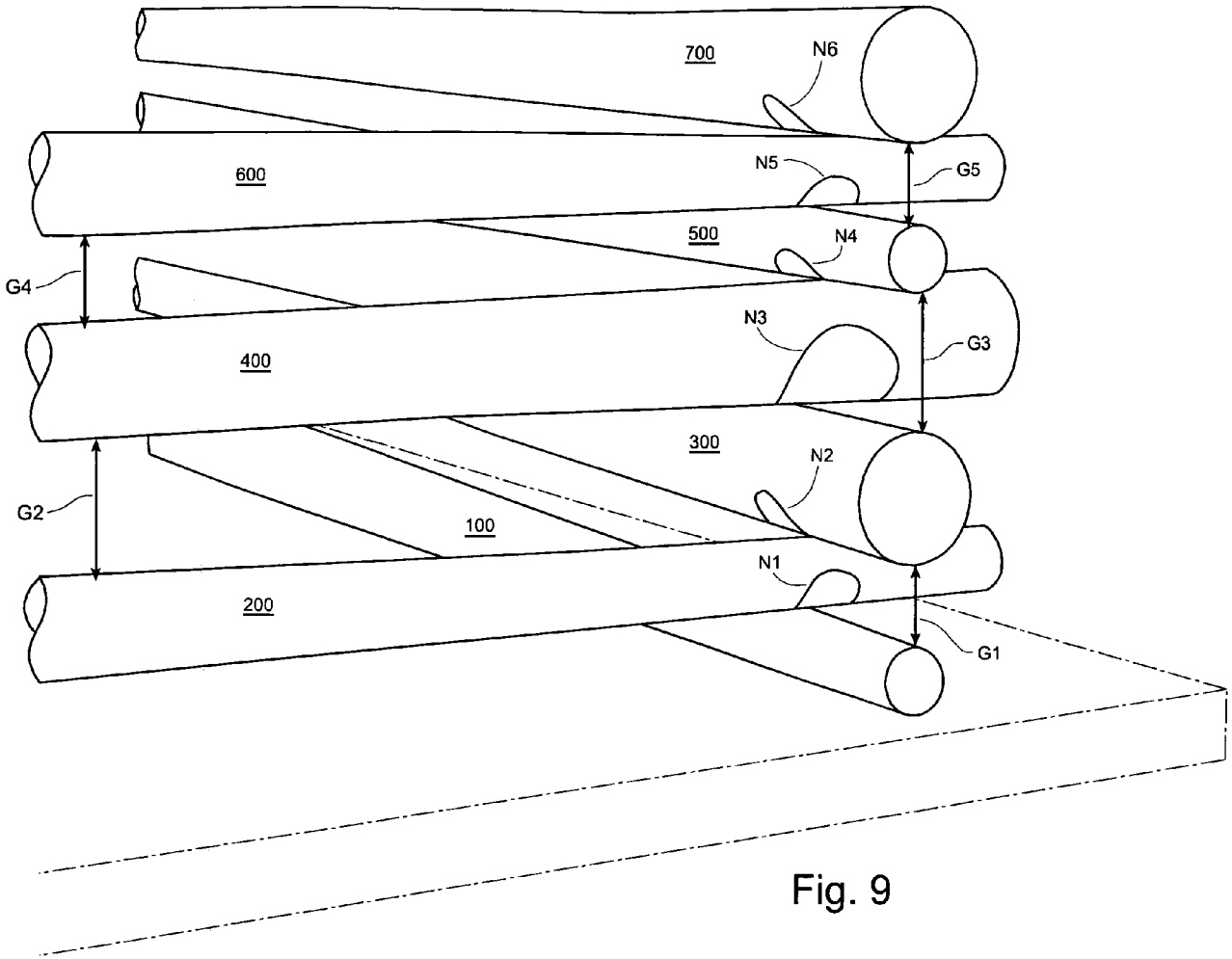
FIG. 9 shows a partially broken-away perspective view of a corner of a crosswise stack of logs in accordance with certain embodiments of the present invention.

The equation discussed above can be expanded, and can perhaps best be understood in relation to FIG. 9. In the following expanded equation, it is assumed that all notch and long groove cut determinations are made by scribing. It is further assumed that this equation applies to a given corner of a stacked assembly. Furthermore, the following equation is written assuming that x is a positive integer greater than one.

$$N_x=(-1)^{x-1}(N_1-G_1+G_2-G_3+G_4-G_5 \ldots G_{x-1})$$

Wherein $N_x$ is the scriber setting for a final notch that is in a given corner and on the end region of a log that is in layer x+1;

$N_1$ is the scribe setting for the final notch that is in the given corner and on the end region of second-layer log 200;

$G_1$ is the scribe setting for the long groove of the third-layer log 300 that is a component of the given corner;

$G_2$ is the scribe setting for the long groove of the fourth-layer log 400 that is a component of the given corner;

$G_3$ is the scribe setting for the long groove of the fifth-layer log 500 that is a component of the given corner;

$G_4$ is the scribe setting for the long groove of the sixth-layer log 600 that is a component of the given corner;

$G_5$ is the scribe setting for the long groove of the seventh-layer log 700 that is a component of the given corner; and so on;

$G_x$ is the scribe setting for the long groove of the log in layer x+2 that is a component of the given corner.

Figure 11:
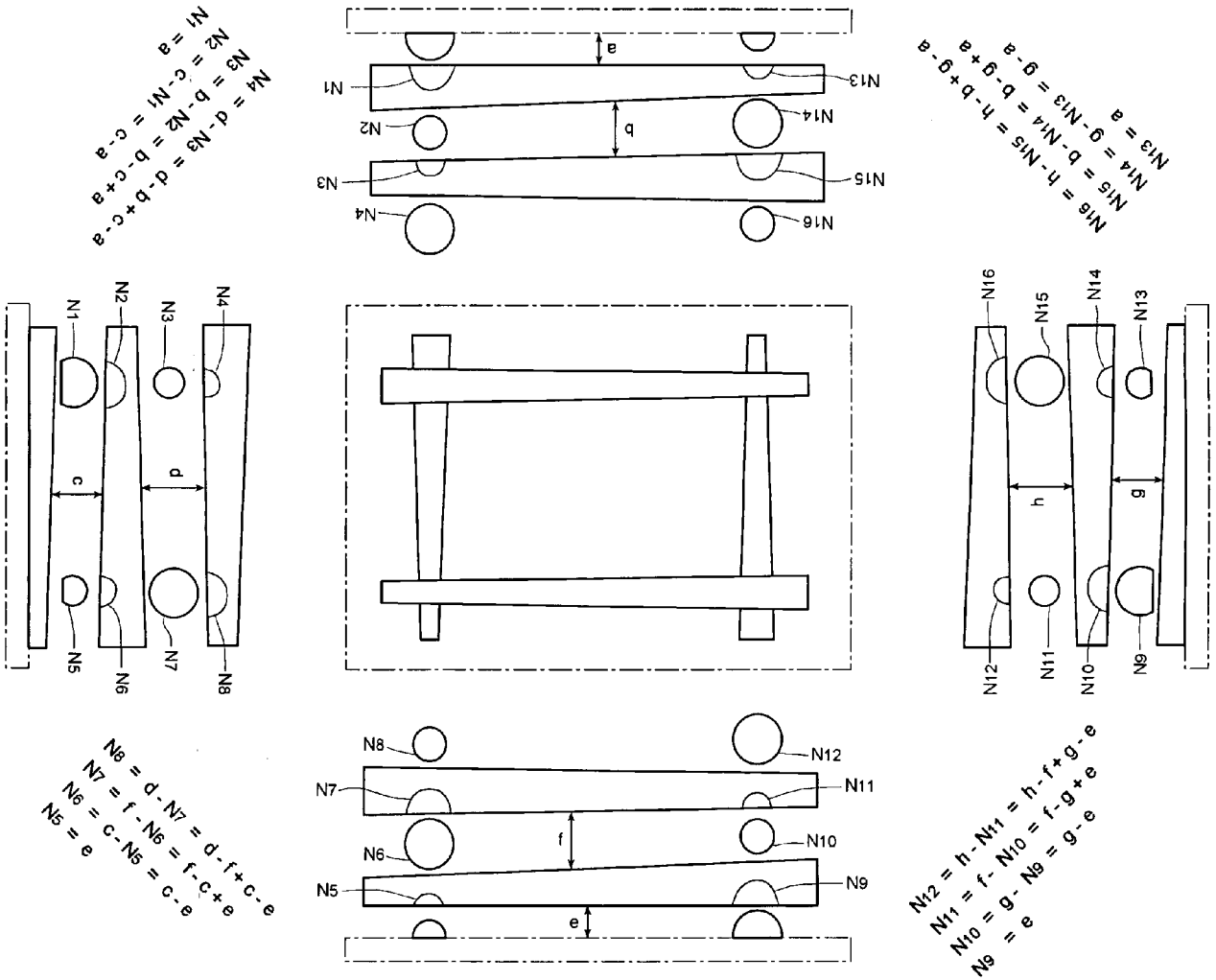
FIG. 11 is a schematic representation of a top view, and four side views, of an assembly of logs in accordance with certain embodiments of the invention, with equations shown to represent certain dimensional relationships.

Thus, the invention provides certain method and assembly embodiments wherein the above equations are implemented. Reference is made to FIG. 11, which schematically depicts an exemplary 4-wall embodiment in which the above equations are adopted. Here, there is illustrated a top view showing the exemplary 4-wall arrangement, and four side views respectively showing the relative locations of the logs defining the four walls in this embodiment. The illustrated logs are held by a plurality of log-positioning apparatuses, as has been described. However, for ease of discussion and illustration, they are not shown here. The wall having the reference characters a, b in its side view is referred to as the "first wall", the wall having the reference characters c, d in its side view is referred to as the "second wall", the wall having the reference characters e, f in its side view is referred to as the "third wall", and the wall having the reference characters g, h in its side view is referred to as the "fourth wall". The reference characters b, c, d, f, g, h refer to scriber settings used for scribing the long grooves on the logs shown directly above respective ones of these reference characters. Reference characters a, e refer to scriber settings used respectively for scribing the final corner notches on the two second-layer sill logs. Here, relative relationships are shown by the equation between each pair of adjacent side views. The reference characters $N_1$, $N_2$, $N_3$, $N_4$, $N_5$, $N_6$, $N_7$, $N_8$, $N_9$, $N_{10}$, $N_{11}$, $N_{12}$, $N_{13}$, $N_{14}$, $N_{15}$, $N_{16}$ refer respectively to scriber settings used for scribing the final corner notches on the log end region adjacent to the location of the relevant reference character.

In the above-noted second group of embodiments, the method involves scribing long groove lines on two different logs of the same layer respectively using two different scriber settings. One such method involves: (1) positioning a first layer of logs in a spaced-apart arrangement; (2) positioning a second layer of logs above the first layer of logs in a crosswise arrangement wherein each end region of each second-layer log rests above a first-layer log, and; (3) positioning a third layer of logs above the second layer of logs in a crosswise arrangement wherein each end region of each third-layer log rests above a second-layer log. Here, each third-layer log preferably lies above and extends alongside an adjacent first-layer log to define a pair of adjacent first-layer and third-layer logs, whereby a first gap is formed between each such pair of adjacent first-layer and third-layer logs. In the present method, there preferably are at least two first gaps in the stack assembly that results from positioning the three layers of logs in the noted manner. Here, the method involves scribing long groove lines on 1st and 2nd of the third-layer logs. Preferably, a first long groove scriber setting is used for scribing the long groove lines on the 1st third-layer log and a second long groove scriber setting is used for scribing the long groove lines on the 2nd third-layer log (the first and second long groove scriber settings are different here). In these methods, at such time as the noted long groove line scribing is performed on the 1st and 2nd third-layer logs, at least one (optionally a plurality, substantially all, or even all) of the second-layer logs has not been cut so as to have final corner notches. Exemplary methods of this nature have been mentioned above.

In embodiments of the noted second group, the method can optionally include scribing final corner notch lines on both end regions of a selected log from one of the second and third layers. In the present embodiments, one final notch scriber setting preferably is used for scribing the final corner notch lines on one of the end regions of the selected log while a different final notch scriber setting is used for scribing the final corner notch lines on the other end region of the selected log.

In some of the present method embodiments, the logs define at least three walls, including first and second walls that form at their intersection a corner. Here, the first wall includes a 1st second-layer log having left and right end regions, and the right end region of the $1^{st}$ second-layer log is at the corner between the first and second walls. Conjointly, the second wall includes the 1st third-layer log, the 1st third-layer log has right and left end regions, and the left end region of the 1st third-layer log is at the corner between the first and second walls. Here again, "right" and "left" are as seen from a vantage point outside the structure directly in front of the log or wall in question. The present method can optionally include scribing final corner notch lines on the right end region of the 1st second-layer log using a first final notch scriber setting, and scribing final corner notch lines on the left end region of the 1st third-layer log using a second final notch scriber setting. Here, the second final notch scriber setting preferably is at least substantially equal to the first long groove scriber setting less the first final notch scriber setting.

Further, in some of the present methods, the logs define second and third walls that form at their intersection a corner. Here, the third wall includes a 2nd second-layer log having left and right end regions, the left end region of the 2nd second-layer log is at the corner between the second and third walls, and the right end region of the 1st third-layer log is at the intersecting corner between the second and third walls. The present method can optionally include scribing final corner notch lines on the left end region of the 2nd second-layer log using a third final notch scriber setting, and scribing final corner notch lines on the right end region of the $1^{st}$ third-layer log using a fourth final notch scriber setting. Preferably, the fourth final notch scriber setting here is at least substantially equal to the first long groove scriber setting less the third final notch scriber setting.

In some of the present embodiments, the third wall and a fourth wall form at their intersection a corner. Here, the fourth wall includes the 2nd third-layer log, the 2nd third-layer log has left and right end regions, and the left end region of the 2nd third-layer log is at the intersecting corner between the third and fourth walls. In such cases, the method can optionally include scribing final corner notch lines on the right end region of the 2nd second-layer log using a fifth final notch scriber setting, and scribing final corner notch lines on the left end region of the 2nd third-layer log using a sixth final notch scriber setting. The sixth final notch scriber setting preferably is at least substantially equal to the second long groove scriber setting less the fifth final notch scriber setting.

Thus, in some of the present methods, the structure is a 4-wall structure. In some of these cases, the fourth wall and the first wall form at their intersection a corner, the right end region of the 2nd third-layer log is at the corner between the fourth and first walls, and the left end region of the 1st second-layer log is at the corner between the fourth and first walls.

Optionally, the method in these cases can include scribing final corner notch lines on the left end region of the 1st second-layer log using a seventh final notch scriber setting, and scribing final corner notch lines on the right end region of the 2nd third-layer log using an eighth final notch scriber setting. Preferably, the eighth final notch scriber setting is at least substantially equal to the second long groove scriber setting less the seventh final notch scriber setting.

In many of the present embodiments, the logs define at least five walls. For example, the fourth wall and a fifth wall can optionally form at their intersection a corner, and the fifth wall can include a 3rd second-layer log having a left end region at the corner between the fourth and fifth walls. In such cases, the method can optionally include scribing final corner notch lines on the left end region of the 3rd second-layer log using a seventh final notch scriber setting, and scribing final corner notch lines on the right end region of the 2nd third-layer log using an eighth final notch scriber setting. Preferably, the eighth final notch scriber setting here is at least substantially equal to the second long groove scriber setting less the seventh final notch scriber setting.

In certain of the present embodiments, the logs define at least six walls. Some of these embodiments involve three first gaps, and, with respect to the third-layer logs above such three first gaps, different long groove scriber settings can optionally be used on different logs to mark long groove scribe lines.

In one subgroup of the second embodiment group, the method includes providing a plurality of overlying layers of logs. Here, the overlying layers are designated for final positioning in the structure (e.g., in the building being constructed) above the third-layer logs. For such logs of the overlying layers, within a given layer, different long groove scriber settings can optionally be used on different logs to mark long groove scribe lines. Additionally or alternatively, for the logs of such overlying layers, the final notch scriber setting used on a right end region of each log can optionally be different than the final notch scriber setting used on a left end region of the same log.

Selected Embodiments

Embodiment 1) Scribe settings may be simplified, in one alternate aspect of the present invention, in the following way: one common long groove scriber setting can be used for all of the wall logs in the entire structure. In this case, the builder would use a long groove scriber setting slightly greater than the greatest gap anticipated between any pair of adjacent logs in the structure; and would use one, common final notch scribe setting for all of the second-layer logs. With the final notch scribe setting of the second-layer determined, and one common long groove scribe setting for all layers, then the final notch scribe settings for the logs of all the layers above the second-layer will be fixed. In such a case, the final notch scribe settings for every log in the higher remaining layers will be equal to the common scribe setting used for all the grooves less the scribe setting used for the second-layer final notches. (This result would also be found using either of the two forms of the equation above.)

To apply this method, the builder would position and orient each new log (when incrementally added to the top of assembly stack) so that its widest gap is preferably equal to, or at least not larger than, the common widest gap. That is, each new log after it is added to the stacked assembly, and before it is scribed, would have its actual widest gap adjusted to the desired widest (common) gap by positioning the elevation of the arms supporting the given new log, by adjusting a height adjustment rod, or the like, supporting the given new log, by adjusting a lateral position rod, or the like, by rough-notching one or both end-regions of the new log, or by any desirable combination of such adjustments, to achieve a widest gap that is substantially equal to, or at least not greater than, the common gap.

In reference to Accelerated Log Building (see, e.g., U.S. Pat. No. 6,412,241, issued to Chambers), it may be difficult to use one common scribe setting for the long grooves of all the logs of a structure because as the stacked shell gets taller and taller, the weight of the logs compresses the rough notches of logs in layers below, thereby reducing the widest gap that had been established earlier between layers. In a tall, stacked shell it may be difficult to achieve the goal of a common widest gap between all layers. Those logs that have a widest gap that is smaller than the desired common gap, will have a long groove that is laterally wider and vertically deeper than preferred. And it is typical of accelerated stacked shells taller than about six layers to have a variety of widest gaps, some of which are smaller than the desired (common) widest gap, and therefore for those logs to have long grooves that are wider and deeper (sometimes significantly wider and deeper) than is preferred. Wide and deep long grooves waste wood (logs) because wall height is lost when long grooves that are wider than optimal are cut into the bottom surface of a log. In the present method, in contrast, achieving a common widest gap for each new log is relatively simple and significantly more reliable, and the long grooves that are scribed therefore more closely approximate the preferred width and depth.

In such an embodiment, the formula above condenses so that in all the layers above the second layer the corner notches are scribed with a setting equal to $N_x=G-N_1$. That is, the final scribe setting of the final notch of a log in any layer ($N_x$) equals the given common long groove scribe setting (G), minus the common final notch scribe setting of logs in the second layer (that is, $N_1$). For example, if all the long grooves of the stacked shell were to be scribed with a scribe setting of 13", and if $N_1$ final notches were scribed with a setting of 7", then the final notches of logs in all the other layers would be scribed with a setting of 6". $N_x=G-N_1$ equals (in this example) 13" minus 7", which equals 6".

Embodiment 2) The present method can also be used to construct log buildings that do not have continuous long grooves when the fully processed logs are fitted into their final, permanent locations in the walls. Such structures are sometimes called "chinked" log homes, and they typically have gap(s) between layers of logs. The contour of at least one log in the structure (and, typically, many of the logs) has not been fully scribed to match and fit the contour of a log below. The gaps, or "chinks," are sometimes filled with a caulking-type ("chinking") semi-elastic material.

The arithmetic relationship described above for the final notch scribe and long groove scribe settings can also be used to construct chinked log homes; and the incremental stacked-assembly method can also be applied with good results; and the jigs or apparatuses described above can be used to hold the logs that will be processed into a chinked log home.

Embodiment 3) Log homes are typically constructed of log walls that may have a variety of designs, configurations, and sizes (dimensions and heights). Log homes sometimes also include some logs that do not have long grooves and such logs are therefore not typical log-wall members. Examples of these logs include both structural and decorative logs used as, for example, floor joists, beams, plate logs, some roof logs, outrigger logs, corbels, stub logs, and the like. The instant assembly, and the method, and the jigs described above allow for such other logs to be included in log structure. The incremental stacked assembly method allows such logs to be positioned and scribed to meet, and to be scribed and/or notched into, log wall(s) as desired. And the apparatuses described above (for holding layers of wall logs) are also suitable for holding, positioning, adjusting, fixing, and incrementally lowering such auxiliary logs.

Embodiment 4) Machine-peeled logs, or manufactured logs, could be used instead of hand-peeled logs (with their natural shapes and sizes). This would make construction faster by reducing or eliminating the variety of log shapes and sizes. When the logs have less individuality and variety, then log selection is easier, adjusting log position and orientation (and therefore maintaining good control over the widest gaps between layers) is easier, and scribing is easier.

Embodiment 5) Wall logs in a stacked assembly can optionally have one, or more, rough-notches. FIG. 10 shows a stacked assembly of a simple, four-wall structure, and with logs 410, 420, 430 of three layers being held by positioning apparatuses 10. Rough-notches (or "pre-notches") are well-known to builders who use them for a variety of purposes in traditional, one-log-at-a-time log construction. In the present invention, it may be advantageous to cut one, or more, rough notches in some, or in a plurality of, logs. But this in no way is a requirement that any log have a rough notch. An entire structure can be constructed without using any rough notch, as has been described above.

In reference to FIG. 10, second-layer log 420 has a rough notch 401 in one end region. In this figure, a rough notch has been cut into the large (butt) end region (L) of a log, however, a rough notch can alternatively be cut in the small (tip) end region of a log. Further, it is not a requirement that rough notches be cut into all the logs of a given layer. For example, one log of a given layer could have a rough notch, but the other log(s) (if any) of the same layer may not have rough notches. A large number of combinations of these options is possible, as well: for example, one log of a given layer could have two rough notches, and another log of the same layer could have one rough notch, or could have no rough notch. Depending in part upon the design of a structure, a given log may have three, or more, final notches, and so it could also have none, one, two, three, or more, rough-notches.

In the present method, one exemplary advantage to rough notching a log can be to reduce the size of the widest gap between two logs. That is, a rough notch may enable the bottom side region of third-layer log 430 to be closer to the top side region of first-layer log 410, and so to have a widest gap 415 that is smaller in magnitude than would be the case if no rough notch 401 had been cut. A smaller widest gap allows the use of a smaller long groove scribe setting, since, as described above, a given long groove scribe setting is slightly greater than the dimension of a given widest gap. It can be more difficult to obtain the desired scribing accuracy if a scribe setting of more than 16 inches (or so) is used, than if a scribe setting of less than that amount is used. A smaller long groove scribe setting may also be easier and faster for the builder to scribe.

Note that it is alternatively possible to reduce the size of a widest gap 415 by cutting a rough notch (not shown) in the small end region (S) of third-layer log 430 instead of, or in addition to, a rough notch 401 in the end region of second-layer log 420.

The depth of a rough notch 401 in second-layer log 420 is such that when log 420 is fitted over first-layer log 410 below, then third-layer log 430 can be lowered to a position in which the vertical height of the gap 415 has become smaller. Desirable results may be obtained when the size of a widest gap 415 is slightly (about one inch, or more) larger than the diameter of the largest small end (tip) log in the structure. A common goal is a parallel gap between two logs, and if the far end is about equal to a tip diameter (plus an inch or so), then the near end would also be about equal to a tip diameter (plus an inch or so). This is not a requirement, however, and a widest gap equal to an amount that is less than the diameter of the largest small end diameter (tip) may also be used. Alternatively, a widest gap that is more than (and even considerably more than) the diameter of the largest small end diameter (tip) may also be used.

Even after rough notching, there will commonly (e.g., in embodiments involving naturally-shaped logs) be one area where the gap between each pair of adjacent first-layer logs 410 and third-layer logs 430 is greatest. This is because each log may have a unique and irregular shape. In some embodiments, the shape corresponds to the natural shape of the tree from which it came. Further, and as described above, it may be desirable for the shape of the gap between the bottom side region of third-layer log 430 and the top side region of first-layer log 410 to be approximately parallel, though this is by no means a requirement.

Ramification 1 concerns a technique variously called underscribing or overscribing. This is a technique of varying the scribe settings of the corner notches so that newly-completed log shells have tightly-fitting corner notches and slightly loose long grooves. Over time, as the logs lose moisture and therefore shrink in diameter, some of the weight is subsequently transferred from the corner notches and to the long grooves. The final notch scribe-setting is calculated as above and then is reduced by the underscribe (overscribe) amount desired for that log.

Ramification 2 concerns flattening sill logs. The logs that rest upon the foundation or sub-floor typically will be flattened on their bottom side region to provide bearing surfaces and stability. All sill logs can be flattened before they are stacked in the assembly. Or sill logs of the first-layer can be flattened and sill logs of the second-layer can be not flattened on the bottom side region until after being removed from the stacked assembly. Or both first-layer and second-layer sill logs could be not flattened on their bottom side regions while they are in the stacked assembly, using the method described above. Those options that delay cutting flats on some of the sill logs have the advantage of allowing for flexibility in the height of the wall, and also the location (elevation) of door headers, which is useful because it allows door headers to be located in convenient portion of the "header" log.

Thus, embodiments of the METHODS, APPARATUSES, AND ASSEMBLIES FOR LOG BUILDING are disclosed. One skilled in the art will appreciate that the present invention can be practiced with embodiments other than the preferred ones disclosed, and so it should be understood that various changes, adaptations, and modifications may be made therein without departing from the spirit of the invention. The disclosed embodiments are presented for purposes of illustration and not limitation, and the present invention is limited only by the claims that follow.

What is claimed is:

1. A method for scribing or otherwise determining final corner notch indicia and long groove indicia for logs to be used in building a structure, the method comprising providing an assembly that includes a plurality of logs, the logs being provided in a stack assembly that includes a plurality of log-positioning apparatuses holding logs of the stack assembly, the stack assembly comprising:

a) a first-layer log held in a desired position;

b) a second-layer log held in a position wherein at least one end region of the second-layer log is disposed above the first-layer log; and c) a third-layer log held in a position wherein at least one end region of the third-layer log is disposed above the second-layer log;

wherein said first-layer log, second-layer log, and third-layer log are identified for being assembled together with other logs to produce a predetermined shell, the predetermined shell having a desired total number of layers of logs, and wherein said stack assembly has at least one less layer of logs than said desired total number;

the method comprising:

i) while said first-layer log, second-layer log, and third-layer log are maintained in said stack assembly, determining final corner notch indicia for said second-layer log and determining long groove indicia for said third-layer log, and thereafter;

ii) removing said first-layer log from said stack assembly while maintaining said second-layer log and third-layer log in said stack assembly such that after removing said first-layer log said second-layer log defines at least part of a lowermost layer of said stack assembly, and;

iii) adjusting said stack assembly by moving each of said second-layer log and said third-layer log to a lower elevation, said adjusting of the stack assembly comprising adjusting a plurality of the log-positioning apparatuses so as to cause vertical movement of each of said second-layer log and said third-layer log to the lower elevation.

2. The method of claim 1 wherein said stack assembly has an uppermost layer of logs that is close enough to the ground to allow a builder to scribe final notch and long groove lines on logs of the uppermost layer while standing on the ground.

3. The method of claim 2 wherein a bottom surface of the uppermost layer of logs is no more than about 70 inches above the ground.

4. The method of claim 1 wherein said stack assembly has logs from only three layers, and the method involves said stack assembly having no more than three layers of logs at any given time.

5. The method of claim 1 wherein said adjusting the log-positioning apparatuses is performed by causing vertical motion of support arms of the log-positioning apparatuses, said support arms supportably receiving respective bottom side regions of logs of the stack assembly.

6. The method of claim 5 wherein each of the log-positioning apparatuses comprises an adjustment shaft having a long axis, wherein said adjusting the log-positioning apparatuses comprises rotating each adjustment shaft about its long axis, and wherein said rotating each adjustment shaft causes said vertical motion of support arms.

7. The method of claim 5 wherein said vertical motion of support arms involves downwardly moving support arms of at least a group of the log-positioning apparatuses.

8. The method of claim 1 wherein said vertical motion of support arms involves moving support arms of at least a group of the log-positioning apparatuses simultaneously by a common increment.

9. The method of claim 8 wherein said vertical motion of support arms is initiated by actuating one or more motors.

10. The method of claim 9 wherein said vertical motion of support arms is initiated by actuating a plurality of motors, each log-positioning apparatus having a motor.

11. The method of claim 10 wherein the method comprises operating a controller to simultaneously actuate at least a subset of the motors.

12. The method of claim 1 comprising adding a first-overlying-layer log to a top of said stack assembly, the first-overlying-layer log being added such that at least one end region of the first-overlying-layer log is disposed above a subjacent log that is part of said stack assembly.

13. The method of claim 12 wherein said adding the first-overlying-layer log to the top of the stack assembly is performed after said removing the first-layer log from the stack assembly.

14. The method of claim 12 wherein said first-overlying-layer log is a fourth-layer log and said subjacent log is said third-layer log, said fourth-layer log being above and extending alongside said second-layer log, the method further comprising:

(1) determining final corner notch indicia for said third-layer log and determining long groove indicia for said fourth-layer log, and thereafter;

(2) removing the second-layer log from said stack assembly while maintaining said third-layer log and fourth-layer log in said stack assembly such that after removing the second-layer log said third-layer log defines at least part of a lowermost layer of said stack assembly, and;

(3) adjusting said stack assembly by moving each of said third-layer log and said fourth-layer log to a lower elevation.

15. The method of claim 14 comprising adding a fifth-layer log to a top of said stack assembly, the fifth-layer log being added such that at least one end region of the fifth-layer log is disposed above the fourth-layer log, said fifth-layer log being added to the top of said stack assembly after step (3) of claim 14.

16. The method of claim 1 wherein the method involves a log-layer-removal repetition technique comprising a plurality of cycles, wherein each cycle includes removing a lowermost layer of logs from a bottom of said stack assembly and moving said stack assembly vertically downwardly.

17. The method of claim 16 wherein each cycle includes adding an uppermost layer of logs to a top of said stack assembly and scribing logs of at least one layer of said stack assembly.

18. The method of claim 16 wherein each cycle includes, in sequence:

(1) scribing logs of at least one layer of said stack assembly;

(2) said removing a lowermost layer of logs from the bottom of said stack assembly; and (3) said moving said stack assembly vertically downwardly; and (4) adding an uppermost layer of logs to a top of said stack assembly.

19. The method of claim 18 wherein the repetition technique includes at least four cycles.

20. The method of claim 18 wherein the cycles are continued until all logs of the desired total number of layers have been scribed.

21. The method of claim 20 wherein the stack assembly remains generally the same height until the desired total number of layers have been scribed.

22. The method of claim 1 wherein said first-layer log, second layer-log, and third-layer log are naturally shaped logs.

23. The method of claim 1 wherein said adjusting the stack assembly by moving each of said second-layer log and said third-layer log to a lower elevation involves moving said second-layer log and said third-layer log downwardly by the same amount.

24. The method of claim 1 wherein said adjusting the stack assembly by moving each of said second-layer log and said third-layer log to a lower elevation involves uniformly lowering said second-layer log and said third-layer log while maintaining a constant spatial relationship among those logs.

25. The method of claim 1 wherein the stack assembly includes a plurality of first-layer logs, a plurality of second-layer logs, and a plurality of third-layer logs.

26. The method of claim 25 wherein said adjusting the stack assembly includes lowering all the logs held by the apparatuses in unison and by the same distance.

27. The method of claim 25 wherein the plurality of first-layer logs form a first layer of logs, the plurality of second-layer logs form a second layer of logs, and the plurality of third-layer logs form a third layer of logs, the second layer of logs being positioned in a crosswise stack above the first layer of logs, and the third layer of logs being positioned in a crosswise stack above the second layer of logs.

28. The method of claim 1 wherein the method includes using two different scriber settings respectfully for scribing long groove lines on two different logs of the same layer.

29. The method of claim 1 wherein, when the stack assembly is initially provided in accordance with claim 1 a), the first-layer log is held above ground.

30. The method of claim 1, wherein step iii) is performed after step ii).

* * * * *